US009183812B2

(12) United States Patent
Myers et al.

(10) Patent No.: US 9,183,812 B2
(45) Date of Patent: Nov. 10, 2015

(54) AMBIENT LIGHT AWARE DISPLAY APPARATUS

(71) Applicant: Pixtronix, Inc., San Diego, CA (US)

(72) Inventors: Robert L. Myers, Andover, MA (US); Jignesh Gandhi, Burlington, MA (US)

(73) Assignee: Pixtronix, Inc., San Diego, CA (US)

( * ) Notice: Subject to any disclaimer, the term of this patent is extended or adjusted under 35 U.S.C. 154(b) by 0 days.

(21) Appl. No.: 13/753,261

(22) Filed: Jan. 29, 2013

(65) Prior Publication Data

US 2014/0210802 A1 Jul. 31, 2014

(51) Int. Cl.
*G09G 5/06* (2006.01)
*G09G 3/34* (2006.01)

(52) U.S. Cl.
CPC ..... *G09G 5/06* (2013.01); *G09G 3/3413* (2013.01); *G09G 3/3426* (2013.01); *G09G 3/346* (2013.01); *G09G 3/3433* (2013.01); *G09G 2320/0666* (2013.01); *G09G 2360/144* (2013.01)

(58) Field of Classification Search
CPC . G09G 3/3413; G09G 3/3426; G09G 3/3433; G09G 5/06; G09G 2320/0666; G09G 2360/144; G09G 3/346
USPC ..... 345/207
See application file for complete search history.

(56) References Cited

U.S. PATENT DOCUMENTS 3,977,022 A 8/1976 Sunstein
4,044,213 A 8/1977 Kinney
4,380,024 A 4/1983 Olofsson
4,559,535 A 12/1985 Watkins et al.
4,564,836 A 1/1986 Vuilleumier et al.
4,847,603 A 7/1989 Blanchard
4,878,741 A 11/1989 Fergason
5,061,049 A 10/1991 Hornbeck
5,062,689 A 11/1991 Koehler
5,093,652 A 3/1992 Bull et al.
5,096,279 A 3/1992 Hornbeck et al.

(Continued)

FOREIGN PATENT DOCUMENTS

CN 101071200 A 11/2007
EP 0830032 A2 3/1998

(Continued)

OTHER PUBLICATIONS

International Search Report and Written Opinion—PCT/US2014/011808—ISA/EPO—Aug. 12, 2014.

(Continued)

*Primary Examiner* — Charles V Hicks
(74) *Attorney, Agent, or Firm* — Edward A. Gordon; Foley & Lardner LLP

(57) ABSTRACT

Systems, apparatus, and methods are disclosed herein for adjusting the operation of a display based on ambient lighting conditions. One such apparatus includes a sensor input for receiving sensor data indicative of an ambient lighting condition, output logic and color gamut correction logic. The output logic is configured to simultaneously cause light sources of at least two colors to be illuminated to form each of at least three generated primary colors. The color gamut correction logic is configured to cause the output logic to adjust the output of at least one display light source for each of the at least three generated primary colors to change the saturation of each of the at least three generated primary colors based on the received ambient light sensor data.

21 Claims, 20 Drawing Sheets

(56) References Cited

U.S. PATENT DOCUMENTS 5,142,405 A 8/1992 Hornbeck
5,233,385 A 8/1993 Sampsell
5,233,459 A 8/1993 Bozler et al.
5,243,894 A 9/1993 Minovitch
5,278,652 A 1/1994 Urbanus et al.
5,280,277 A 1/1994 Hornbeck
5,319,491 A 6/1994 Selbrede
5,339,116 A 8/1994 Urbanus et al.
5,359,345 A 10/1994 Hunter
5,452,024 A 9/1995 Sampsell
5,461,411 A 10/1995 Florence et al.
5,493,439 A 2/1996 Engle
5,497,172 A 3/1996 Doherty et al.
5,510,824 A 4/1996 Nelson
5,517,347 A 5/1996 Sampsell
5,523,803 A 6/1996 Urbanus et al.
5,526,051 A 6/1996 Gove et al.
5,548,301 A 8/1996 Kornher et al.
5,724,062 A 3/1998 Hunter
5,731,802 A 3/1998 Aras et al.
5,745,193 A 4/1998 Urbanus et al.
5,745,281 A 4/1998 Yi et al.
5,760,760 A 6/1998 Helms
5,771,321 A 6/1998 Stern
5,784,189 A 7/1998 Bozler et al.
5,794,761 A 8/1998 Renaud et al.
5,835,255 A 11/1998 Miles
5,835,256 A 11/1998 Huibers
5,914,804 A 6/1999 Goossen
5,952,992 A 9/1999 Helms
5,973,315 A 10/1999 Saldana et al.
5,986,796 A 11/1999 Miles
6,008,929 A 12/1999 Akimoto et al.
6,034,807 A 3/2000 Little et al.
6,040,937 A 3/2000 Miles
6,046,840 A 4/2000 Huibers
6,057,878 A 5/2000 Ogiwara et al.
6,069,676 A 5/2000 Yuyama
6,172,797 B1 1/2001 Huibers
6,201,633 B1 3/2001 Peeters et al.
6,213,615 B1 4/2001 Siitari
6,225,991 B1 5/2001 McKnight
6,249,269 B1 6/2001 Blalock et al.
6,288,824 B1 9/2001 Kastalsky
6,300,154 B2 10/2001 Clark et al.
6,323,834 B1 11/2001 Colgan et al.
6,329,974 B1 12/2001 Walker et al.
6,388,388 B1 5/2002 Weindorf et al.
6,388,648 B1 5/2002 Clifton et al.
6,388,661 B1 5/2002 Richards
6,424,329 B1 7/2002 Okita
6,567,063 B1 5/2003 Okita
6,597,419 B1 7/2003 Okada et al.
6,600,474 B1 7/2003 Heines et al.
6,633,301 B1 10/2003 Dallas et al.
6,650,455 B2 11/2003 Miles
6,657,611 B1 12/2003 Sterken et al.
6,671,078 B2 12/2003 Flanders et al.
6,674,562 B1 1/2004 Miles
6,680,792 B2 1/2004 Miles
6,701,039 B2 3/2004 Bourgeois et al.
6,762,741 B2 7/2004 Weindorf
6,762,743 B2 7/2004 Yoshihara et al.
6,775,048 B1 8/2004 Starkweather et al.
6,795,064 B2 9/2004 Walker et al.
6,798,935 B2 9/2004 Bourgeois et al.
6,844,959 B2 1/2005 Huibers et al.
6,873,311 B2 3/2005 Yoshihara et al.
6,879,307 B1 4/2005 Stern
6,900,072 B2 5/2005 Patel et al.
6,906,847 B2 6/2005 Huibers et al.
6,911,964 B2 6/2005 Lee et al.
6,969,635 B2 11/2005 Patel et al.
6,980,349 B1 12/2005 Huibers et al.
6,982,820 B2 1/2006 Tsai
7,025,464 B2 4/2006 Beeson et al.
7,042,618 B2 5/2006 Selbrede et al.
7,046,221 B1 5/2006 Malzbender
7,050,219 B2 5/2006 Kimura
7,057,790 B2 6/2006 Selbrede
7,092,142 B2 8/2006 Selebrede et al.
7,113,339 B2 9/2006 Taguchi et al.
7,119,944 B2 10/2006 Patel et al.
7,123,216 B1 10/2006 Miles
7,123,796 B2 10/2006 Steckl et al.
7,126,738 B2 10/2006 Miles
7,198,982 B2 4/2007 Patel et al.
7,215,459 B2 5/2007 Huibers et al.
7,218,437 B2 5/2007 Selbrede
7,227,677 B2 6/2007 Ravnkilde et al.
7,271,790 B2 9/2007 Hudson et al.
7,274,416 B2 9/2007 Feenstra et al.
7,297,929 B2 11/2007 Cernasov et al.
7,315,294 B2 1/2008 Richards
7,327,510 B2 2/2008 Cummings et al.
7,463,227 B2 12/2008 Van Gorkom et al.
7,492,356 B1 2/2009 Pruitt
7,524,097 B2 4/2009 Turnbull et al.
7,595,811 B2 9/2009 Matsuda
7,643,203 B2 1/2010 Gousev et al.
7,660,028 B2 2/2010 Lan
7,737,912 B2 6/2010 Graef et al.
7,786,420 B2 8/2010 Yan et al.
7,800,698 B2 9/2010 Quan et al.
7,860,305 B2 12/2010 Wang et al.
7,864,204 B2 1/2011 Overes
7,876,058 B2 1/2011 Price et al.
7,898,521 B2 3/2011 Gally et al.
8,207,955 B2 6/2012 Morimoto
8,279,138 B1 10/2012 Margulis
2002/0006044 A1 1/2002 Harbers et al.
2002/0113808 A1 8/2002 Weindorf et al.
2003/0020672 A1 1/2003 Takatori
2003/0130562 A1 7/2003 Barbato et al.
2003/0231160 A1 12/2003 Yoshihara et al.
2004/0008288 A1 1/2004 Pate et al.
2004/0017337 A1 1/2004 Lin
2004/0054921 A1 3/2004 Land
2004/0080484 A1 4/2004 Heines et al.
2004/0178973 A1 9/2004 Miller et al.
2004/0188599 A1 9/2004 Viktorovitch et al.
2004/0233298 A1 11/2004 Aotsuka
2004/0246275 A1 12/2004 Yoshihara et al.
2004/0263502 A1 12/2004 Dallas et al.
2005/0062708 A1 3/2005 Yoshihara et al.
2005/0067553 A1 3/2005 Agari et al.
2005/0073471 A1 4/2005 Selbrede
2005/0083352 A1 4/2005 Higgins
2005/0088102 A1 4/2005 Ferguson et al.
2005/0088404 A1 4/2005 Heines et al.
2005/0104804 A1 5/2005 Feenstra et al.
2005/0122560 A1 6/2005 Sampsell et al.
2005/0168431 A1 8/2005 Chui
2005/0190142 A1 9/2005 Ferguson
2005/0206991 A1 9/2005 Chui et al.
2005/0212734 A1 9/2005 Kimura
2005/0212738 A1 9/2005 Gally
2006/0044246 A1 3/2006 Mignard
2006/0044928 A1 3/2006 Chui et al.
2006/0056178 A1 3/2006 Len-Li et al.
2006/0061559 A1 3/2006 King
2006/0065940 A1 3/2006 Kothari
2006/0066937 A1 3/2006 Chui
2006/0077124 A1 4/2006 Gally et al.
2006/0077148 A1 4/2006 Gally et al.
2006/0077149 A1 4/2006 Gally et al.
2006/0092182 A1 5/2006 Diefenbaugh et al.
2006/0152476 A1 7/2006 Van Gorkom et al.
2006/0172745 A1 8/2006 Knowles
2006/0227085 A1 10/2006 Boldt, Jr. et al.
2006/0238443 A1 10/2006 Derichs
2006/0250325 A1 11/2006 Hagood et al.
2007/0047051 A1 3/2007 Selbrede et al.
2007/0047887 A1 3/2007 Selbrede

(56) References Cited

U.S. PATENT DOCUMENTS

| | | | | |
|---|---|---|---|---|
| 2007/0052735 | A1 | 3/2007 | Chou | |
| 2007/0120765 | A1 | 5/2007 | Misonou et al. | |
| 2007/0139405 | A1 | 6/2007 | Marcinkiewicz | |
| 2007/0146356 | A1 | 6/2007 | Ladouceur | |
| 2007/0146565 | A1 | 6/2007 | Jeon et al. | |
| 2007/0172171 | A1 | 7/2007 | Van Ostrand et al. | |
| 2007/0242291 | A1 | 10/2007 | Harigai | |
| 2008/0001910 | A1 | 1/2008 | Lim | |
| 2008/0002062 | A1 | 1/2008 | Kim et al. | |
| 2008/0143844 | A1 | 6/2008 | Innocent | |
| 2008/0191978 | A1 | 8/2008 | Miles | |
| 2008/0203279 | A1 | 8/2008 | Kobashi | |
| 2008/0238840 | A1 | 10/2008 | Raman et al. | |
| 2008/0288225 | A1 | 11/2008 | Djordjev | |
| 2008/0297466 | A1 | 12/2008 | Kunimori et al. | |
| 2008/0303806 | A1 | 12/2008 | Perrin | |
| 2008/0303918 | A1 | 12/2008 | Keithley | |
| 2009/0091560 | A1 | 4/2009 | Ferguson | |
| 2009/0225396 | A1 | 9/2009 | Sampsell | |
| 2009/0235006 | A1 | 9/2009 | Desrosiers et al. | |
| 2009/0237382 | A1 | 9/2009 | Kunimori | |
| 2010/0103186 | A1 | 4/2010 | Luengen et al. | |
| 2010/0118008 | A1 | 5/2010 | Matsuoka | |
| 2010/0149145 | A1 | 6/2010 | Van Woudenberg et al. | |
| 2010/0187422 | A1 | 7/2010 | Kothari et al. | |
| 2010/0188443 | A1 | 7/2010 | Lewis et al. | |
| 2010/0220109 | A1 | 9/2010 | Aoki et al. | |
| 2010/0245313 | A1 | 9/2010 | Lewis et al. | |
| 2010/0321414 | A1 | 12/2010 | Muroi et al. | |
| 2011/0006690 | A1 | 1/2011 | Hoffman et al. | |
| 2011/0074808 | A1 | 3/2011 | Huang et al. | |
| 2011/0148751 | A1 | 6/2011 | Gally et al. | |
| 2011/0199350 | A1 | 8/2011 | Wilson | |
| 2011/0205259 | A1* | 8/2011 | Hagood, IV | 345/690 |
| 2011/0235154 | A1 | 9/2011 | Ji | |
| 2012/0050307 | A1 | 3/2012 | Mahowald et al. | |
| 2012/0236042 | A1 | 9/2012 | Parmar et al. | |
| 2012/0242232 | A1 | 9/2012 | Yata et al. | |
| 2013/0050165 | A1 | 2/2013 | Northway et al. | |
| 2013/0100096 | A1 | 4/2013 | Webster et al. | |

FOREIGN PATENT DOCUMENTS

| | | | |
|---|---|---|---|
| EP | 1091342 | A2 | 4/2001 |
| EP | 1217598 | A2 | 6/2002 |
| EP | 1640761 | | 3/2006 |
| EP | 1734502 | A1 | 12/2006 |
| EP | 2362372 | A1 | 8/2011 |
| EP | 1942680 | A3 | 5/2012 |
| FR | 2760559 | A1 | 9/1998 |
| GB | 2321532 | A | 7/1998 |
| JP | H07255063 | A | 10/1995 |
| JP | 09281917 | | 10/1997 |
| JP | 11211999 | A | 8/1999 |
| JP | 2000231092 | A | 8/2000 |
| JP | 2001268405 | A | 9/2001 |
| JP | 2004096593 | A | 3/2004 |
| JP | 2005130325 | A | 5/2005 |
| JP | 2007036695 | A | 2/2007 |
| JP | 2008514997 | A | 5/2008 |
| JP | 2010102150 | A | 5/2010 |
| JP | 2012203192 | A | 10/2012 |
| KR | 1020010099592 | | 11/2001 |
| KR | 1020040035678 | | 4/2004 |
| WO | 0070597 | A1 | 11/2000 |
| WO | 2006017129 | A2 | 2/2006 |
| WO | 2006036559 | A1 | 4/2006 |
| WO | 2007120464 | | 10/2007 |
| WO | 2007127876 | A2 | 11/2007 |
| WO | 2011112962 | A1 | 9/2011 |

OTHER PUBLICATIONS

Akimoto O. et al., "15.1: A 0.9-in UXGA/HDTV FLC Microdisplay," Society for Information Display, 2000, pp. 194-197.

Alt P.M., et al., "A Gray-Scale Addressing Technique for Thin-Film-Transistor/Liquid Crystal Displays," IBM J. Res. Develop., 36 (1), Jan. 1992, pp. 11-22.

Application as filed in U.S. Appl. No. 13/278,516 (QCO.390A), dated Oct. 21, 2011.

Bergquist et al., "Field Sequential Colour Display with Adaptive Gamut", Society for Information Display, Digest of Technical Papers, 2006, pp. 1594-1597.

Boer W.D., "Active Matrix Liquid Crystal Displays", Elsevier Science & Technology Books, ISBN #0750678135, Aug. 2005.

Chino E. et al., "25.1: Invited Paper: Development of Wide-Color-Gamut Mobile Displays with Four-primary-color LCDs," Society for Information Display, 37 (2), 2006, pp. 1221-1224.

Clark N. A., et al., "FLC Microdisplays", Ferroelectrics, 246, 2000, pp. 97-110.

Doherty D. et al., "Pulse Width Modulation Control of DLP Projectors", TI Technical Journal, Jul.-Sep. 1998, No. 3, pp. 115-121.

Feenstra J. et al., "Electrowetting Displays", Liquavista BV, http://www.liquavista.com/documents/electrowetting__displays__whitepaper.pdf, Retrieved on Aug. 17, 2006, pp. 1-16.

Hornbeck J. "Digital Light Processing TM: A New MEMS-Based Display Technology," Technical Digest of the IEEJ 14th Sensor Symposium, Jun. 4-5, 1996, pp. 297-304.

"Image technology colour management—Architecture, profile format, and data structure", Specification ICC.1:2004-10 (Profile version 4.2.0.0) International Color Consortium 2004, available at http:"L/vywy.y"color"pmdCCj.y4Z__ZQMT95,pcjf, May 22, 2006, in 112.

Jaatinen T. "Essentials of Mobile User Interface", SID Mobile Displays, San Diego, CA, 2007.

Konno, et al., "RGB color control system for LED backlights in IPS-LCD TVs. SID symposium digest of technical papers," Section 3-4, 2005, pp. 1381-1383.

Kubota, et al., "Measurement of Light Incident on Mobile Displays in Various Environments", Journal of the SID, 2006, 14 (11), pp. 999-1002.

Kunzman A. et al., "10.3 White Enhancement for Color Sequential DLP", Society for Information Display, Digest of Technical Papers, 1998.

Kwon O. S., et al., "High Fidelity Color Reproduction of Plasma Displays under Ambient Lighting", IEEE Transactions on Consumer Electronics, Aug. 2009, 55(3), 1015-1020.

Lee, et al., "40.1: Distingusihed Contributed Paper: Integrated Amorphous Silicon Color Sensor on LCD Panel for LED Backlight Feedback Control System", Society for Information Display, Digest of Technical Papers, 2005, pp. 1376-1379.

Manzardo, et al., "Optics and Actuators for Miniaturized Spectrometers," International Conference on Optical MEMS, 2003, 12(6), 23-24.

Markandey V. et al., "Video Processing for DLP Display Systems," Texas Instruments Corporation, Mar. 13, 1996, pp. 21-32.

Miles M.W., "A MEMS Based Interferometric Modulator (IMOD) for Display Applications" Proceedings of Sensors Expo, Oct. 21, 1997 © 1997 Helmer's Publishing, Inc. (Oct. 21, 1997), pp. 281-284 XP009058455.

Miles M.W., "A New Reflective FPD Technology using Interferometric Modulation," Journal of the SID, 1997, vol. 5(4), 379-382.

Miles M.W. et al., "Interferometric Modulation a MEMS Based Technology for the Modulation of Light," Final Program and Proceedings IS&T's 50th Annual Conference, 1997, pp. 674-677.

Miles M.W., "MEMS-Based Interferometric Modulator for Display Applications," Proceedings of SPIE Conference on Micromachined Devices and Components V, Sep. 1999, SPIE vol. 3876, pp. 20-28.

Pasricha S. et al., "Dynamic Backlight Adaptation for Low Power Handheld Devices" IEEE Design and Test v. 21, 2004, pp. 398.

Ravnkilde J., et al., "Fabrication of Nickel Microshutter Arrays for Spatial Light Modulation", Mesomechanics, 2002, pp. 161-165. Also on their web site: http://www2.mic.dtu.dk/research/mems/publications/Papers/Dicon__Meso2002.pdf.

(56) References Cited

OTHER PUBLICATIONS

"RGB to XYZ", available from http://www.brucelindbloom.com/Egn RGB to XYZ .html, Jan. 7, 2011., in 2 pages.
RGB/XYZ Matrices, available from http://www.brucelindbloom.com/ Ecin RGB to XYZ Matrix.html, Dec. 20, 2011, in 4 pages.
Takatori, et al., "6.3: Field-Sequential Smectic LCD with TFT Pixel Amplifier," SID 01, 2001, Digest, pp. 48-51.
Wang F., et al., "Multivariable Robust Control for a Red-Green-Blue LED Lighting System", Power Electronics, IEEE Transactions on Feb. 2010, vol. 25(2), pp. 417-428, ISSN : 0885-8993.
Wang K., et al., "Highly Space-Efficient Electrostatic Zigzag Transmissive Micro-Optic Switches for an Integrated MEMS Optical Display System", Transducers 03 Conference, Jun. 8-12, 2003, vol. 1, pp. 575-575.
What Ambient Light Sensing Can Do for HDTVs: How ALS can save energy and improve image quality, TAOS, Inc., 8 pgs., Jan. 2010.
Wikipedia, "Color balance", available from htViten, Mar. 21, 2012, in 6 pages, Retrieved from the Internet: <http://en.wikipedia.org/wiki/Color_balance>.
Partial International Search Report—PCT/US2014/011808—ISA/EPO—Apr. 23, 2014.

* cited by examiner

AMBIENT LIGHT AWARE DISPLAY APPARATUS

TECHNICAL FIELD

This disclosure relates to the field of displays, and in particular, to displays configured to adapt their operation to changes in ambient lighting conditions.

DESCRIPTION OF THE RELATED TECHNOLOGY

Electromechanical systems (EMS) display devices, such as nanoelectromechancial systems (NEMS), microelectromechanical systems (MEMS), and larger-scale display devices can effectively generate a wide range of images. Certain backlit display devices, however, can suffer from reduced image quality when used in various ambient lighting settings. Bright ambient light conditions, for example, associated with outdoor viewing, can result in a great deal of reflected ambient light yielding a desaturated image. Some ambient light conditions have greater relative intensities of various colors, resulting in a white point different from a desired image white point. Both phenomena can prevent a display device from faithfully reproducing an image.

SUMMARY

The systems, methods and devices of the disclosure each have several innovative aspects, no single one of which is solely responsible for the desirable attributes disclosed herein.

One innovative aspect of the subject matter described in this disclosure can be implemented in an apparatus that includes a sensor input, output logic, and color gamut correction logic. The input logic is configured to receive sensor data indicative of an ambient lighting condition. The output logic is configured to simultaneously cause light sources of at least two colors to be illuminated to form each of at least three generated primary colors. Each of the at least three generated primary colors corresponds to a nominal primary color of a nominal color gamut and has a chromaticity that is less saturated than a chromaticity of a corresponding light source. The color gamut correction logic is configured, in response to detecting the ambient lighting condition indicated in the received sensor data, to cause the output logic to adjust the output of at least one display light source for each of the at least three generated primary colors to change the saturation of each of the at least three generated primary colors.

In some implementations, the output logic is configured, for a first of the generated primary colors, to cause a first light source having a chromaticity similar to that of the first nominal primary color and a second light source having a substantially different chromaticity from the first nominal primary color to be simultaneously illuminated. In some implementations, the color gamut correction logic causes the output logic to adjust the output of the first generated primary color in response to the detected ambient lighting condition by causing the output logic to alter the relative intensities at which the output logic causes the first and second light sources to be simultaneously illuminated when forming the first generated primary color. In some implementations, the color gamut correction logic causes the output logic to adjust the output of the first generated primary color in response to the detected ambient lighting condition by causing the output logic to reduce the relative intensity at which the output logic causes the second light source to be illuminated when forming the first generated primary color in relation to the intensity at which the output logic causes the first light source to be illuminated when forming the first generated primary color. The color gamut correction logic can cause the output logic to adjust the output of a remainder of the generated primary colors in response to the detected ambient lighting condition such that a perceived white point of the generated color gamut of the display after the adjustment is the same as a perceived white point of the generated color gamut of the display before the adjustment.

In some implementations, the color gamut correction logic is configured to cause the output logic to adjust the output of the first generated primary color in response to the detected ambient lighting condition such that under the ambient lighting condition, the color gamut made available by use of the generated primary colors more closely replicates the nominal color gamut. The color gamut correction logic can be configured to do so by causing the output logic to adjust the output of at least one display light source for each of the at least three generated primary colors such that the color gamut made available through use of the generated primary colors is a scaled version of the nominal color gamut.

In some implementations, the apparatus also includes a memory that stores a lookup table (LUT). The LUT stores a plurality of light source output levels associated with a corresponding plurality of ambient light conditions. The color gamut correction logic can cause the output logic to adjust the output of the first generated primary color in response to the detected ambient lighting condition by forwarding light source output levels obtained from the LUT based on the ambient light conditions to the output logic.

In some implementations, the generated primary colors include red, green, and blue. In some implementations, the nominal color gamut is either the sRGB and Adobe RGB color gamut. In some implementations, the display light sources include light emitting diodes (LEDs).

In some implementations, the apparatus includes a display that includes an array of electromechanical systems (EMS) light modulators, a processor that is configured to communicate with the display and to process image data, and a memory device that is configured to communicate with the processor. In some implementations, the processor includes the sensor input, the color gamut correction logic, and the output logic. In some other implementations, the display includes a display controller incorporating the sensor input, the color gamut correction logic, and the output logic. The apparatus can also include a driver circuit configured to send at least one signal to the display. In some such implementations, the processor is further configured to send at least a portion of the image data to the driver circuit.

In some implementations, the apparatus also can include an image source module configured to send the image data to the processor. The image source module can be at least one of a receiver, transceiver, and transmitter. In some implementations, the apparatus of includes an input device configured to receive input data and to communicate the input data to the processor.

Another innovative aspect of the subject matter described in this disclosure can be implemented in an apparatus that includes means for receiving sensor data indicative of an ambient light condition, output control means, and color gamut correction means. The output control means is configured to simultaneously cause light sources of at least two colors to be illuminated to form each of at least three generated primary colors. Each of the at least three generated primary colors corresponds to a nominal primary color of a nominal color gamut and has a chromaticity that is less saturated than a chromaticity of a corresponding light source. The color gamut correction means is means configured, in response to detecting the ambient lighting condition indicated in the received sensor data, to cause the output control means to adjust the output of at least one display light source for each of the at least three generated primary colors to change the saturation of each of the at least three generated primary colors.

In some implementations, the output control means is configured, for a first of the generated primary colors, to cause a first light source having a chromaticity similar to that of the first nominal primary color and a second light source having a substantially different chromaticity from the first nominal primary color to be simultaneously illuminated. In some implementations, the color gamut correction means causes the output control means to adjust the output of the first generated primary color in response to the detected ambient lighting condition by causing the output control means to alter the relative intensities at which the output control means causes the first and second light sources to be simultaneously illuminated when forming the first generated primary color.

In some implementations, the color gamut correction means causes the output control means to adjust the output of a remainder of the generated primary colors in response to the detected ambient lighting condition such that a perceived white point of the generated color gamut of the display after the adjustment is the same as a perceived white point of the generated color gamut of the display before the adjustment. The color gamut correction means is configured in some implementations to cause the output control means to adjust the output of the first generated primary color in response to the detected ambient lighting condition such that under the ambient lighting condition, the color gamut made available by use of the generated primary colors more closely replicates the nominal color gamut. In some implementations, the color gamut correction means is configured to cause the output control means to adjust the output of at least one display light source for each of the at least three generated primary colors such that the color gamut made available through use of the generated primary colors is a scaled version of the nominal color gamut.

In some implementations, the apparatus can include a storage means storing a LUT. The LUT includes a plurality of light source output levels associated with a corresponding plurality of ambient light conditions. The color gamut correction means causes the output control means to adjust the output of the first generated primary color in response to the detected ambient lighting condition by forwarding light source output levels obtained from the LUT based on the ambient light conditions to the output control means.

Another innovative aspect of the subject matter described in this disclosure can be implemented in a method for adjusting the operation of a display based on ambient lighting conditions. The method includes receiving sensor data indicative of an ambient lighting condition and simultaneously causing light sources of at least two colors to be illuminated to form each of at least three generated primary colors. Each of the at least three generated primary colors corresponds to a nominal primary color of a nominal color gamut and has a chromaticity that is less saturated than a chromaticity of a corresponding light source. The method also includes, in response to detecting the ambient lighting condition indicated in the received sensor data, adjusting the output of at least one display light source for each of the at least three generated primary colors to change the saturation of each of the at least three generated primary colors.

In some implementations, adjusting the output of the first generated primary color in response to the detected ambient lighting condition includes altering the relative intensities at which at least two light sources associated with different colors are simultaneously illuminated when forming the first generated primary color. In some implementations, the method also includes storing in a LUT a plurality of light source output levels associated with a corresponding plurality of ambient light conditions. In some such implementations, adjusting the output of the first generated primary color in response to the detected ambient lighting condition includes adjusting the output of the first generated primary color based on light source output levels obtained from the LUT.

Another innovative aspect of the subject matter described in this disclosure can be implemented in an apparatus that includes a sensor input and color gamut correction logic. The sensor input is configured for receiving sensor data indicative of ambient lighting levels associated with less than three colors. The color gamut correction logic is configured to identify one of a set of ambient lighting light sources based on the received sensor data and to adjust output parameters of a display for displaying an image frame based on the identified ambient lighting light source. In some implementations, the set of ambient lighting light sources includes at least two of direct sunlight, diffuse sunlight, fluorescent lighting, and incandescent lighting.

In some implementations, the apparatus includes a backlight. In some implementations, adjusting the output parameters of the display includes adjusting a white point of the backlight incorporated into the display. In some implementations, the backlight includes light sources of multiple colors and is configured to output each of a set of generated primary colors by simultaneously illuminating light sources of at least two of the multiple colors. Adjusting the white point of the backlight can include adjusting a relative intensity at which the backlight outputs at least one of the generated primary colors. In some other implementations, adjusting the white point of the backlight includes adjusting a chromaticity of at least one of the generated primary colors. In some implementations, the output parameters adjusted by the color gamut correction logic include a backlight brightness level.

In some implementations, the received sensor data includes data sufficient to determine a relative red or orange content of an ambient lighting environment. In some such implementations, the received sensor data includes data indicative of levels of ambient blue light and ambient red or orange light. In some other implementations, the received sensor data includes data indicative of levels of ambient white light and ambient red or orange light.

In some implementations, the apparatus includes a memory storing an ambient light source lookup table (LUT). The color gamut correction logic can be configured to identify the ambient light source using information in the LUT and the received sensor data.

Another innovative aspect of the subject matter described in this disclosure can be implemented in a method for adjusting the operation of a display based on ambient lighting conditions. The method includes receiving sensor data indicative of ambient lighting levels associated with less than three colors, identifying one of a set of ambient lighting light sources based on the received sensor data, and adjusting output parameters of a display for displaying an image frame based on the identified ambient lighting light source. In some implementations, adjusting the output parameters of the display includes adjusting a white point of a backlight incorporated into the display. In some implementations, the method further includes determining a relative red or orange content of an ambient lighting environment.

In some other implementations, the method also includes storing an ambient light source LUT. The ambient light source can be identified by using information in the LUT and the received sensor data.

Details of one or more implementations of the subject matter described in this specification are set forth in the accompanying drawings and the description below. Although the examples provided in this summary are primarily described in terms of MEMS-based displays, the concepts provided herein may apply to other types of displays, such as liquid crystal displays (LCDs), organic light emitting diode (OLED) displays, electrophoretic displays, and field emission displays, as well as to other non-display MEMS devices, such as MEMS microphones, sensors, and optical switches. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
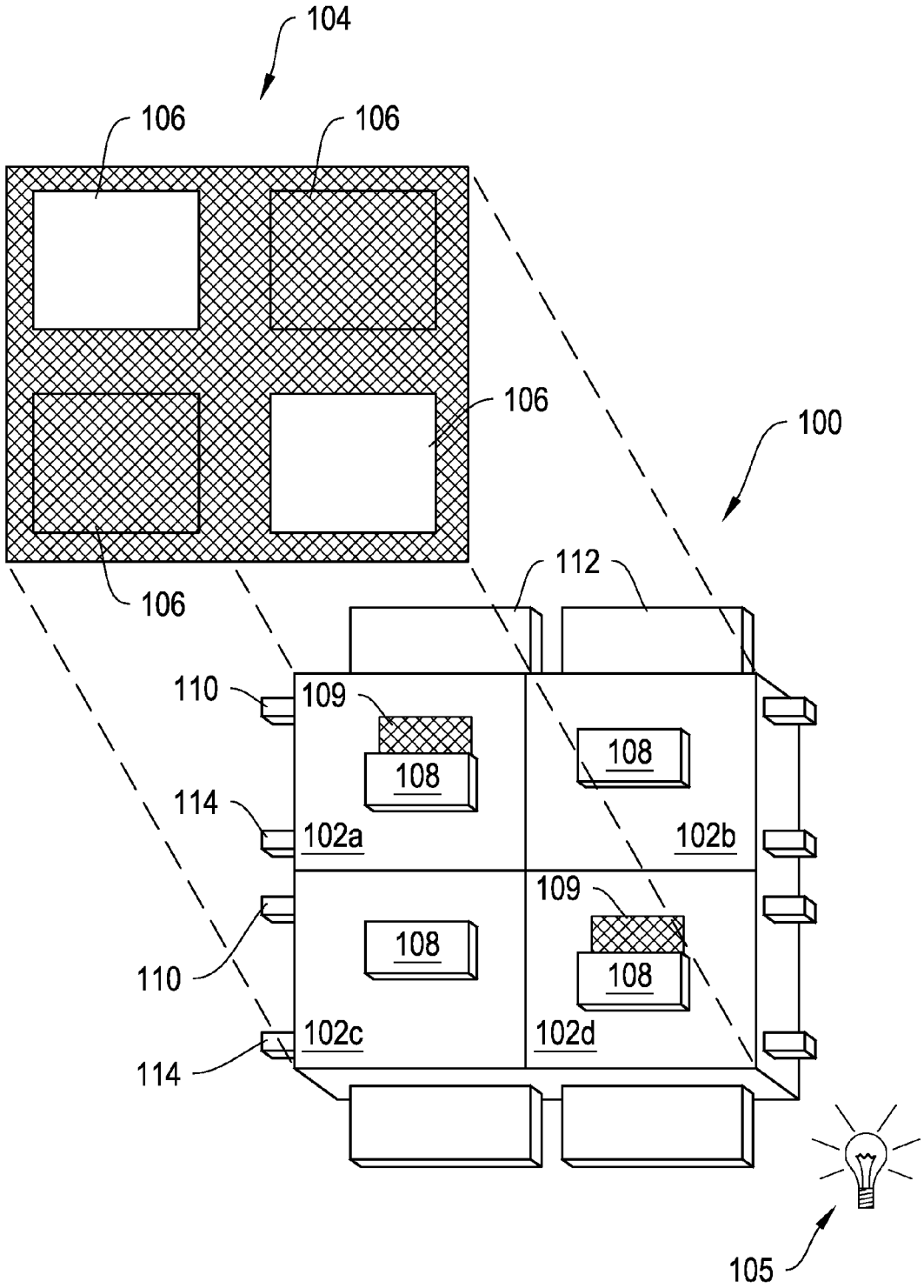
FIG. 1A shows a schematic diagram of an example direct-view microelectromechanical systems (MEMS) based display apparatus.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that can be configured to display an image, whether in motion (such as video) or stationary (such as still images), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, clocks, calculators, television monitors, flat panel displays, electronic reading devices (such as e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, as well as non-EMS applications), aesthetic structures (such as display of images on a piece of jewelry or clothing) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

Images can be more faithfully reproduced if a display apparatus takes into account overall ambient lighting levels and/or the color profile of an ambient lighting source. More particularly, a display controller can adjust the saturation of the display's light sources to expand its color gamut in environments with high overall ambient lighting levels, which tend to desaturate displayed images. Similarly, a controller can utilize sensors that distinguish only two different colors to identify the source of ambient lighting. The display primaries can be adjusted based on the white point of the ambient lighting source to more faithfully reproduce an image in the ambient light conditions. In some implementations, color gamut expansion can be combined with white point adjustment.

Particular implementations of the subject matter described in this disclosure can be implemented to realize one or more of the following potential advantages. Dynamically resaturating a display's primary colors based on detected ambient light conditions allows a display to more faithfully reproduce image content in a variety of ambient lighting conditions. Moreover, by simply resaturating the primary colors without changing the white point of the display, the display need not modify the image data it is displaying to account for the changes in primary colors. Moreover, appropriate adjustments to the display primaries can be stored in a simple lookup table (LUT) after being empirically measured during an initial calibration process. These characteristics, both separately and together, allow the display to counter the deleterious effects of ambient lighting without any meaningful increase to the processing requirements of the display controller.

The two-sensor white point compensation method described above provides a lower-cost, computationally elegant solution to the perceived white point shift that can be caused by ambient light. As with the resaturation process described above, a display employing the white point adjustment process need not adjust the image data it is presenting. It merely needs to adjust the intensity with which it illuminates its light sources, such as light emitting diodes (LEDs). In addition, by only requiring sensing of two colors within the ambient light, one of which can be white, the display can obtain sufficient data to implement the process without the cost or space requirements that would need to be allocated to separately sense three colors of ambient light.

FIG. 1A shows a schematic diagram of an example direct-view MEMS-based display apparatus 100. The display apparatus 100 includes a plurality of light modulators 102*a*-102*d* (generally "light modulators 102") arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide luminance level in an image 104. With respect to an image, a "pixel" corresponds to the smallest picture element defined by the resolution of image. With respect to structural components of the display apparatus 100, the term "pixel" refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the user sees the image by looking directly at the display apparatus, which contains the light modulators and optionally a backlight or front light for enhancing brightness and/or contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a lightguide or "backlight" so that each pixel can be uniformly illuminated. Transmissive direct-view displays are often built onto transparent or glass substrates to facilitate a sandwich assembly arrangement where one substrate, containing the light modulators, is positioned directly on top of the backlight.

Each light modulator 102 can include a shutter 108 and an aperture 109. To illuminate a pixel 106 in the image 104, the shutter 108 is positioned such that it allows light to pass through the aperture 109 towards a viewer. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix connected to the substrate and to the light modulators for controlling the movement of the shutters. The control matrix includes a series of electrical interconnects (such as interconnects 110, 112 and 114), including at least one write-enable interconnect 110 (also referred to as a "scan-line interconnect") per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the "write-enabling voltage, $V_{WE}$"), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, such as transistors or other non-linear circuit elements that control the application of separate actuation voltages, which are typically higher in magnitude than the data voltages, to the light modulators 102. The application of these actuation voltages then results in the electrostatic driven movement of the shutters 108.

Figure 1B:
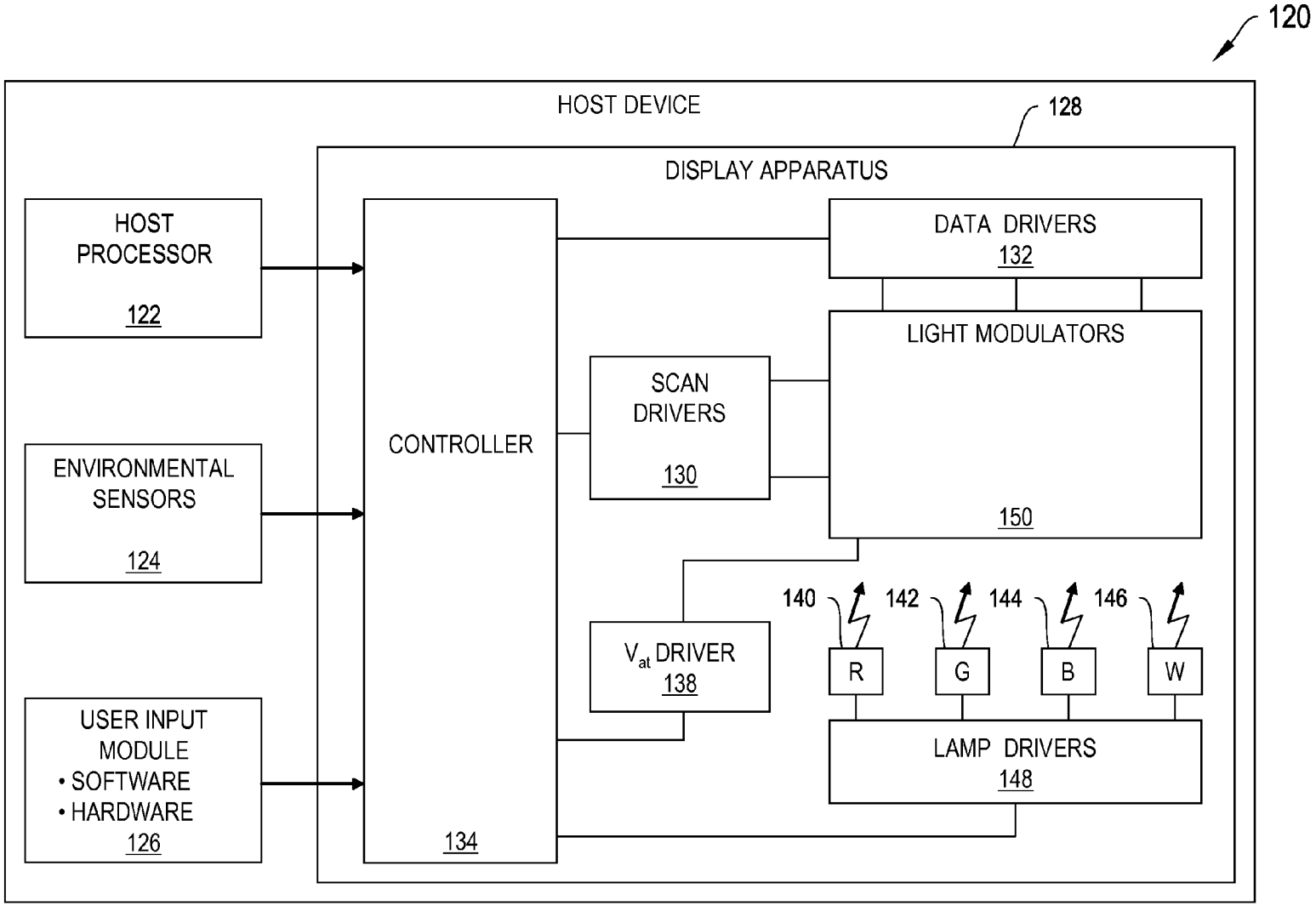
FIG. 1B shows a block diagram of an example host device.

FIG. 1B shows a block diagram of an example host device 120 (i.e., cell phone, smart phone, PDA, MP3 player, tablet, e-reader, netbook, notebook, etc.). The host device 120 includes a display apparatus 128, a host processor 122, environmental sensors 124, a user input module 126, and a power source.

The display apparatus 128 includes a plurality of scan drivers 130 (also referred to as "write enabling voltage sources"), a plurality of data drivers 132 (also referred to as "data voltage sources"), a controller 134, common drivers 138, lamps 140-146, lamp drivers 148 and an array 150 of display elements, such as the light modulators 102 shown in FIG. 1A. The scan drivers 130 apply write enabling voltages to scan-line interconnects 110. The data drivers 132 apply data voltages to the data interconnects 112.

In some implementations of the display apparatus, the data drivers 132 are configured to provide analog data voltages to the array 150 of display elements, especially where the luminance level of the image 104 is to be derived in analog fashion. In analog operation, the light modulators 102 are designed such that when a range of intermediate voltages is applied through the data interconnects 112, there results a range of intermediate open states in the shutters 108 and therefore a range of intermediate illumination states or luminance levels in the image 104. In other cases, the data drivers 132 are configured to apply only a reduced set of 2, 3 or 4 digital voltage levels to the data interconnects 112. These voltage levels are designed to set, in digital fashion, an open state, a closed state, or other discrete state to each of the shutters 108.

The scan drivers 130 and the data drivers 132 are connected to a digital controller circuit 134 (also referred to as the "controller 134"). The controller sends data to the data drivers 132 in a mostly serial fashion, organized in predetermined sequences grouped by rows and by image frames. The data drivers 132 can include series to parallel data converters, level shifting, and for some applications digital to analog voltage converters.

The display apparatus optionally includes a set of common drivers 138, also referred to as common voltage sources. In some implementations, the common drivers 138 provide a DC common potential to all display elements within the array 150 of display elements, for instance by supplying voltage to a series of common interconnects 114. In some other implementations, the common drivers 138, following commands from the controller 134, issue voltage pulses or signals to the array 150 of display elements, for instance global actuation pulses which are capable of driving and/or initiating simultaneous actuation of all display elements in multiple rows and columns of the array 150.

All of the drivers (such as scan drivers 130, data drivers 132 and common drivers 138) for different display functions are time-synchronized by the controller 134. Timing commands from the controller coordinate the illumination of red, green and blue and white lamps (140, 142, 144 and 146 respectively) via lamp drivers 148, the write-enabling and sequencing of specific rows within the array 150 of display elements, the output of voltages from the data drivers 132, and the output of voltages that provide for display element actuation. In some implementations, the lamps are LEDs.

The controller 134 determines the sequencing or addressing scheme by which each of the shutters 108 can be re-set to the illumination levels appropriate to a new image 104. New images 104 can be set at periodic intervals. For instance, for video displays, the color images 104 or frames of video are refreshed at frequencies ranging from 10 to 300 Hertz (Hz). In some implementations the setting of an image frame to the array 150 is synchronized with the illumination of the lamps 140, 142, 144 and 146 such that alternate image frames are illuminated with an alternating series of colors, such as red, green, and blue. The image frames for each respective color is referred to as a color subframe. In this method, referred to as the field sequential color (FSC) method, if the color subframes are alternated at frequencies in excess of 20 Hz, the human brain will average the alternating frame images into the perception of an image having a broad and continuous range of colors. In alternate implementations, four or more lamps with primary colors can be employed in display apparatus 100, employing primaries other than red, green, and blue.

In some implementations, where the display apparatus 100 is designed for the digital switching of shutters 108 between open and closed states, the controller 134 forms an image by the method of time division gray scale, as previously described. In some other implementations, the display apparatus 100 can provide gray scale through the use of multiple shutters 108 per pixel.

In some implementations, the data for an image state 104 is loaded by the controller 134 to the display element array 150 by a sequential addressing of individual rows, also referred to as scan lines. For each row or scan line in the sequence, the scan driver 130 applies a write-enable voltage to the write enable interconnect 110 for that row of the array 150, and subsequently the data driver 132 supplies data voltages, corresponding to desired shutter states, for each column in the selected row. This process repeats until data has been loaded for all rows in the array 150. In some implementations, the sequence of selected rows for data loading is linear, proceeding from top to bottom in the array 150. In some other implementations, the sequence of selected rows is pseudo-randomized, in order to minimize visual artifacts. And in some other implementations the sequencing is organized by blocks, where, for a block, the data for only a certain fraction of the image state 104 is loaded to the array 150, for instance by addressing only every $5^{th}$ row of the array 150 in sequence.

In some implementations, the process for loading image data to the array 150 is separated in time from the process of actuating the display elements in the array 150. In these implementations, the display element array 150 may include data memory elements for each display element in the array 150 and the control matrix may include a global actuation interconnect for carrying trigger signals, from common driver 138, to initiate simultaneous actuation of shutters 108 according to data stored in the memory elements.

In alternative implementations, the array 150 of display elements and the control matrix that controls the display elements may be arranged in configurations other than rectangular rows and columns. For example, the display elements can be arranged in hexagonal arrays or curvilinear rows and columns. In general, as used herein, the term scan-line shall refer to any plurality of display elements that share a write-enabling interconnect.

The host processor 122 generally controls the operations of the host. For example, the host processor 122 may be a general or special purpose processor for controlling a portable electronic device. With respect to the display apparatus 128, included within the host device 120, the host processor 122 outputs image data as well as additional data about the host. Such information may include data from environmental sensors, such as ambient light or temperature; information about the host, including, for example, an operating mode of the host or the amount of power remaining in the host's power source; information about the content of the image data; information about the type of image data; and/or instructions for display apparatus for use in selecting an imaging mode.

The user input module 126 conveys the personal preferences of the user to the controller 134, either directly, or via the host processor 122. In some implementations, the user input module 126 is controlled by software in which the user programs personal preferences such as "deeper color," "better contrast," "lower power," "increased brightness," "sports," "live action," or "animation." In some other implementations, these preferences are input to the host using hardware, such as a switch or dial. The plurality of data inputs to the controller 134 direct the controller to provide data to the various drivers 130, 132, 138 and 148 which correspond to optimal imaging characteristics.

An environmental sensor module 124 also can be included as part of the host device 120. The environmental sensor module 124 receives data about the ambient environment, such as temperature and or ambient lighting conditions. The sensor module 124 can be programmed to distinguish whether the device is operating in an indoor or office environment versus an outdoor environment in bright daylight versus an outdoor environment at nighttime. The sensor module 124 communicates this information to the display controller 134, so that the controller 134 can optimize the viewing conditions in response to the ambient environment.

Figure 2A:
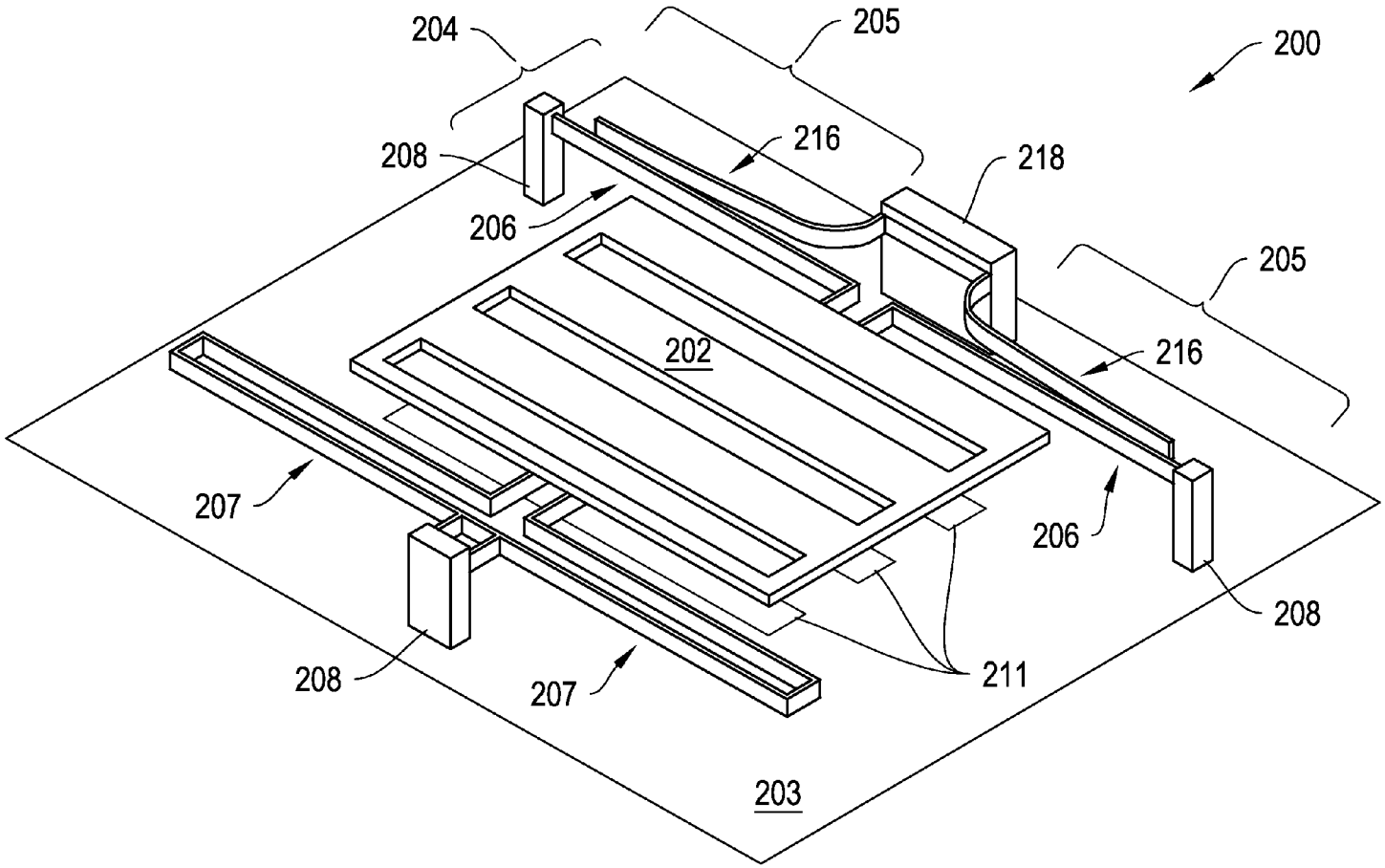
FIG. 2A shows a perspective view of an example shutter-based light modulator.

FIG. 2A shows a perspective view of an example shutter-based light modulator 200. The shutter-based light modulator 200 is suitable for incorporation into the direct-view MEMS-based display apparatus 100 of FIG. 1A. The light modulator 200 includes a shutter 202 coupled to an actuator 204. The actuator 204 can be formed from two separate compliant electrode beam actuators 205 (the "actuators 205"). The shutter 202 couples on one side to the actuators 205. The actuators 205 move the shutter 202 transversely over a surface 203 in a plane of motion which is substantially parallel to the surface 203. The opposite side of the shutter 202 couples to a spring 207 which provides a restoring force opposing the forces exerted by the actuator 204.

Each actuator 205 includes a compliant load beam 206 connecting the shutter 202 to a load anchor 208. The load anchors 208 along with the compliant load beams 206 serve as mechanical supports, keeping the shutter 202 suspended proximate to the surface 203. The surface 203 includes one or more aperture holes 211 for admitting the passage of light. The load anchors 208 physically connect the compliant load beams 206 and the shutter 202 to the surface 203 and electrically connect the load beams 206 to a bias voltage, in some instances, ground.

If the substrate is opaque, such as silicon, then aperture holes 211 are formed in the substrate by etching an array of holes through the substrate 204. If the substrate 204 is transparent, such as glass or plastic, then the aperture holes 211 are formed in a layer of light-blocking material deposited on the substrate 203. The aperture holes 211 can be generally circular, elliptical, polygonal, serpentine, or irregular in shape.

Each actuator 205 also includes a compliant drive beam 216 positioned adjacent to each load beam 206. The drive beams 216 couple at one end to a drive beam anchor 218 shared between the drive beams 216. The other end of each drive beam 216 is free to move. Each drive beam 216 is curved such that it is closest to the load beam 206 near the free end of the drive beam 216 and the anchored end of the load beam 206.

In operation, a display apparatus incorporating the light modulator 200 applies an electric potential to the drive beams 216 via the drive beam anchor 218. A second electric potential may be applied to the load beams 206. The resulting potential difference between the drive beams 216 and the load beams 206 pulls the free ends of the drive beams 216 towards the anchored ends of the load beams 206, and pulls the shutter ends of the load beams 206 toward the anchored ends of the drive beams 216, thereby driving the shutter 202 transversely toward the drive anchor 218. The compliant members 206 act as springs, such that when the voltage across the beams 206 and 216 potential is removed, the load beams 206 push the shutter 202 back into its initial position, releasing the stress stored in the load beams 206.

A light modulator, such as the light modulator 200, incorporates a passive restoring force, such as a spring, for returning a shutter to its rest position after voltages have been removed. Other shutter assemblies can incorporate a dual set of "open" and "closed" actuators and a separate set of "open" and "closed" electrodes for moving the shutter into either an open or a closed state.

There are a variety of methods by which an array of shutters and apertures can be controlled via a control matrix to produce images, in many cases moving images, with appropriate luminance levels. In some cases, control is accomplished by means of a passive matrix array of row and column interconnects connected to driver circuits on the periphery of the display. In other cases it is appropriate to include switching and/or data storage elements within each pixel of the array (the so-called active matrix) to improve the speed, the luminance level and/or the power dissipation performance of the display.

Figure 2B:
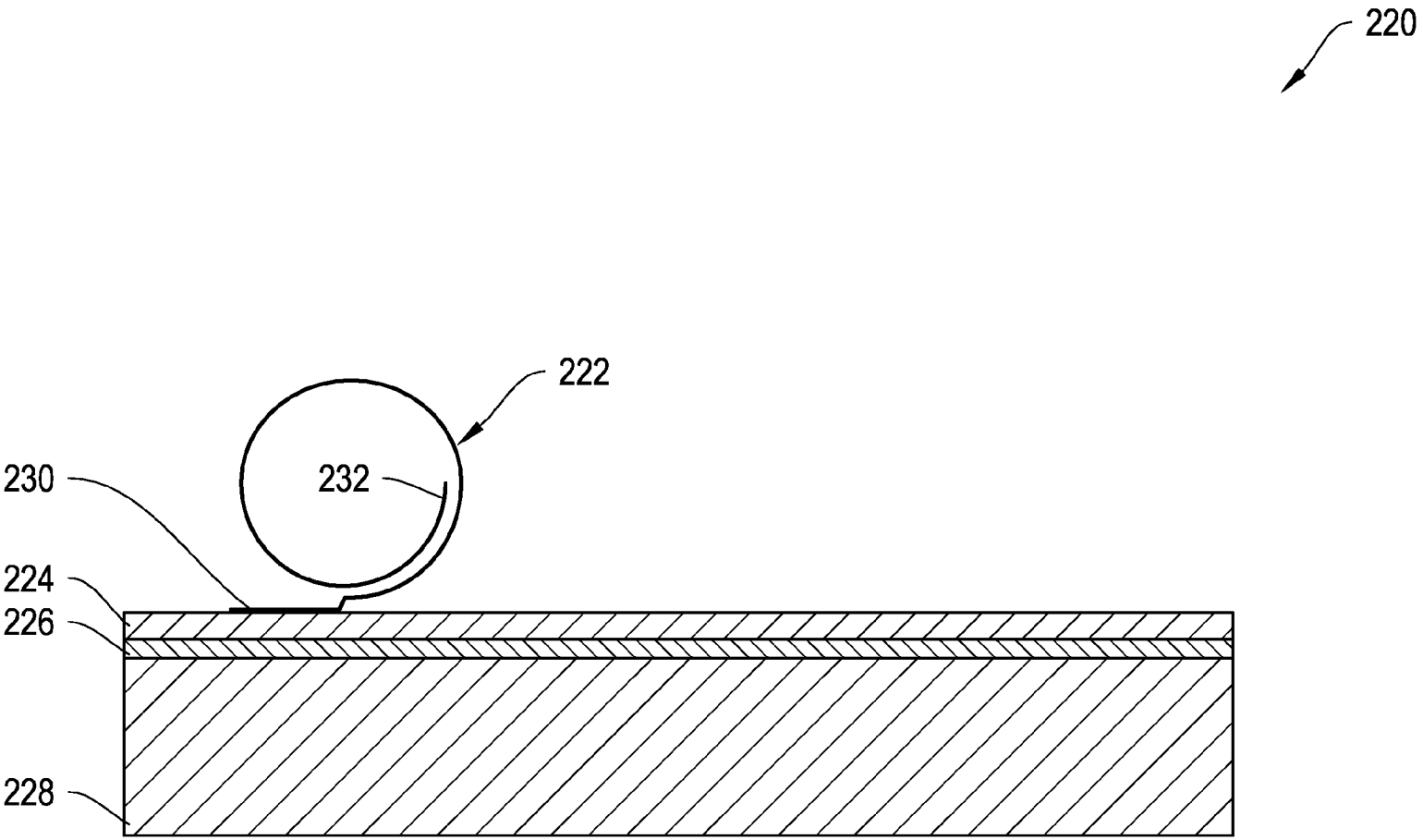
FIG. 2B shows a cross sectional view of an example rolling actuator shutter-based light modulator.

The display apparatus 100, in alternative implementations, includes display elements other than transverse shutter-based light modulators, such as the shutter assembly 200 described above. For example, FIG. 2B shows a cross sectional view of an example rolling actuator shutter-based light modulator 220. The rolling actuator shutter-based light modulator 220 is suitable for incorporation into an alternative implementation of the MEMS-based display apparatus 100 of FIG. 1A. A rolling actuator-based light modulator includes a movable electrode disposed opposite a fixed electrode and biased to move in a particular direction to function as a shutter upon application of an electric field. In some implementations, the light modulator 220 includes a planar electrode 226 disposed between a substrate 228 and an insulating layer 224 and a movable electrode 222 having a fixed end 230 attached to the insulating layer 224. In the absence of any applied voltage, a movable end 232 of the movable electrode 222 is free to roll towards the fixed end 230 to produce a rolled state. Application of a voltage between the electrodes 222 and 226 causes the movable electrode 222 to unroll and lie flat against the insulating layer 224, whereby it acts as a shutter that blocks light traveling through the substrate 228. The movable electrode 222 returns to the rolled state by means of an elastic restoring force after the voltage is removed. The bias towards a rolled state may be achieved by manufacturing the movable electrode 222 to include an anisotropic stress state.

Figure 2C:
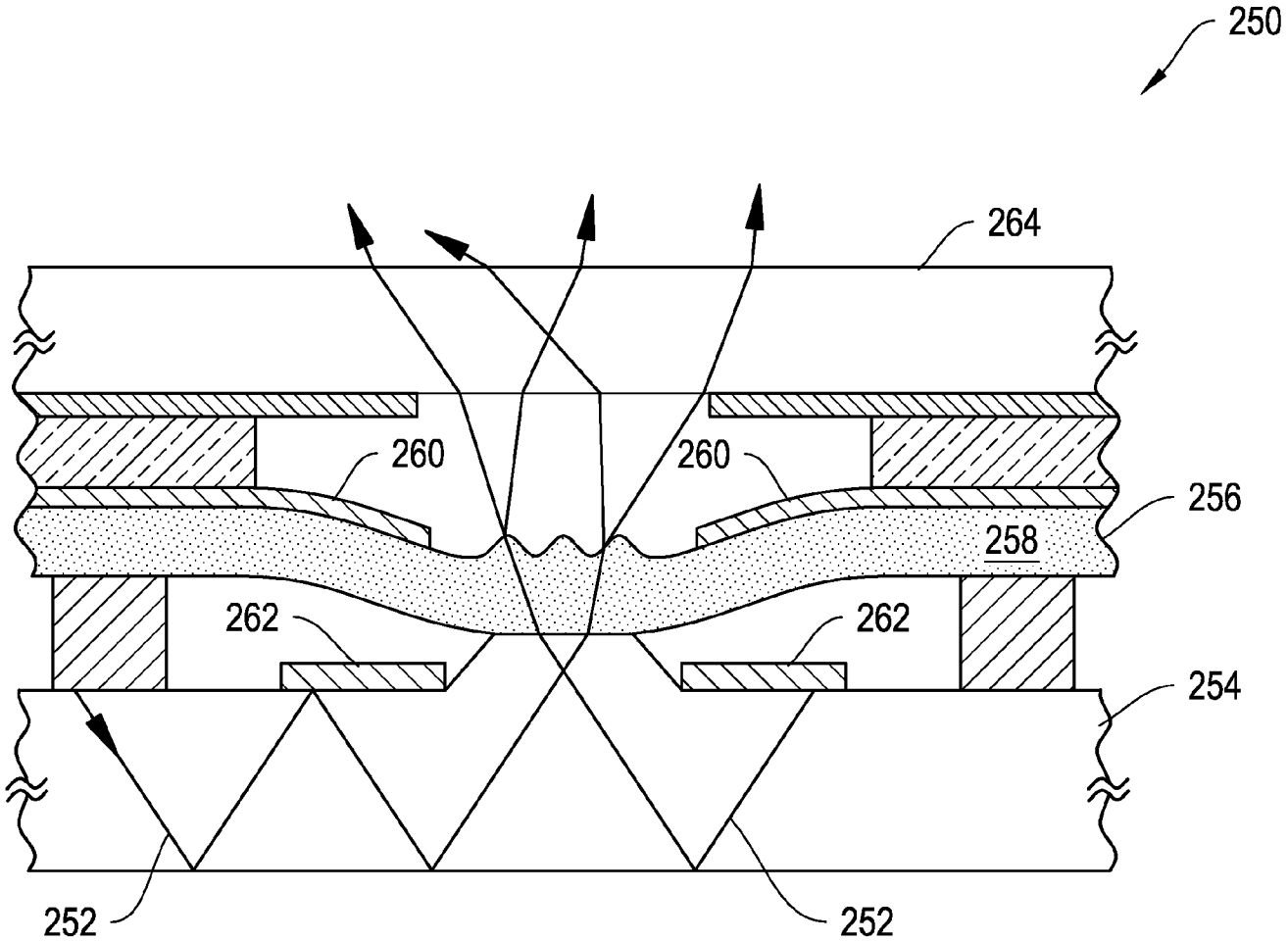
FIG. 2C shows a cross sectional view of an example non shutter-based MEMS light modulator.

FIG. 2C shows a cross sectional view of an example non shutter-based MEMS light modulator 250. The light tap modulator 250 is suitable for incorporation into an alternative implementation of the MEMS-based display apparatus 100 of FIG. 1A. A light tap works according to a principle of frustrated total internal reflection (TIR). That is, light 252 is introduced into a light guide 254, in which, without interference, light 252 is, for the most part, unable to escape the light guide 254 through its front or rear surfaces due to TIR. The light tap 250 includes a tap element 256 that has a sufficiently high index of refraction that, in response to the tap element 256 contacting the light guide 254, the light 252 impinging on the surface of the light guide 254 adjacent the tap element 256 escapes the light guide 254 through the tap element 256 towards a viewer, thereby contributing to the formation of an image.

In some implementations, the tap element 256 is formed as part of a beam 258 of flexible, transparent material. Electrodes 260 coat portions of one side of the beam 258. Opposing electrodes 262 are disposed on the light guide 254. By applying a voltage across the electrodes 260 and 262, the position of the tap element 256 relative to the light guide 254 can be controlled to selectively extract light 252 from the light guide 254.

Figure 2D:
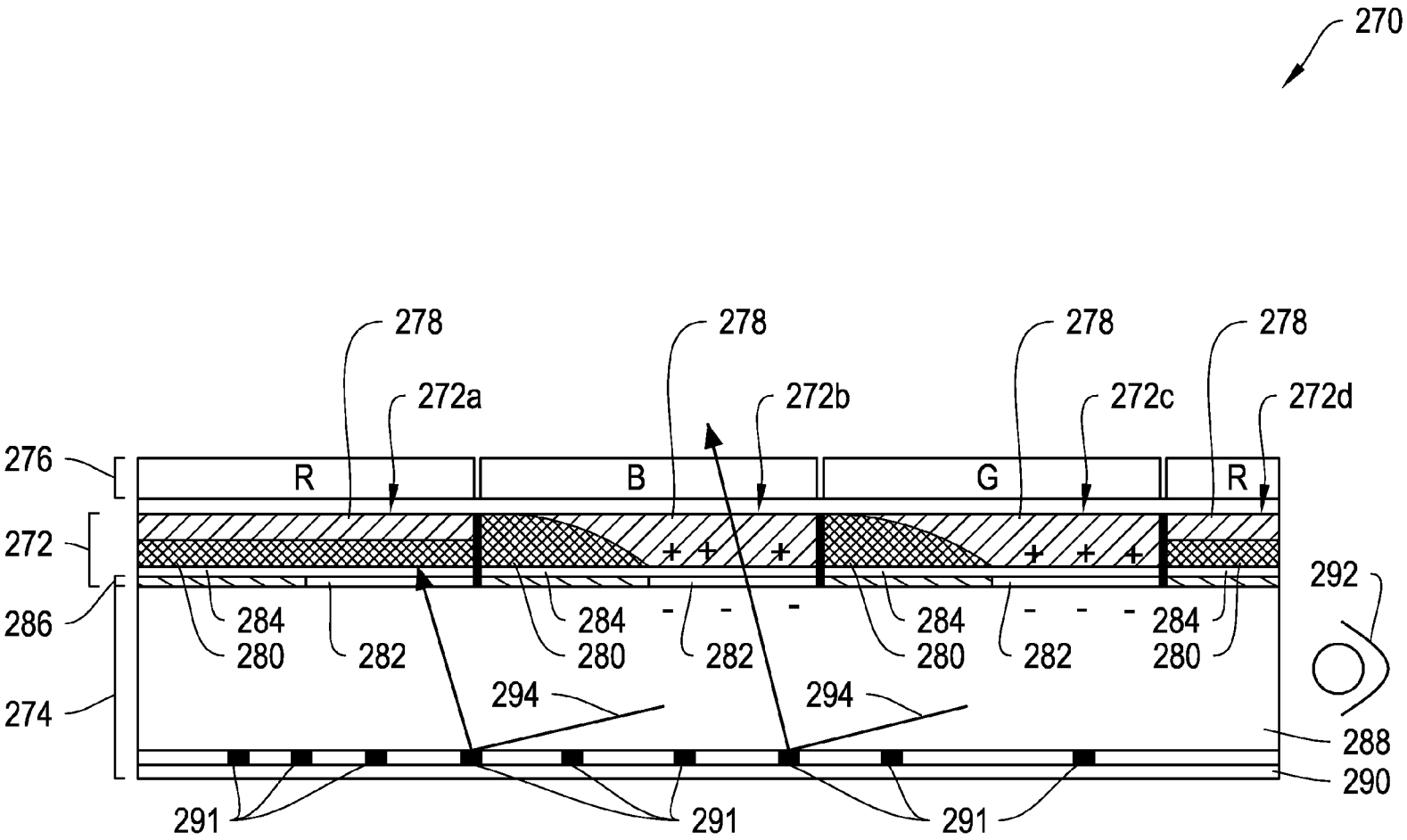
FIG. 2D shows a cross sectional view of an example electrowetting-based light modulation array.

FIG. 2D shows a cross sectional view of an example electrowetting-based light modulation array 270. The electrowetting-based light modulation array 270 is suitable for incorporation into an alternative implementation of the MEMS-based display apparatus 100 of FIG. 1A. The light modulation array 270 includes a plurality of electrowetting-based light modulation cells 272*a-d* (generally "cells 272") formed on an optical cavity 274. The light modulation array 270 also includes a set of color filters 276 corresponding to the cells 272.

Each cell 272 includes a layer of water (or other transparent conductive or polar fluid) 278, a layer of light absorbing oil 280, a transparent electrode 282 (made, for example, from indium-tin oxide (ITO)) and an insulating layer 284 positioned between the layer of light absorbing oil 280 and the transparent electrode 282. In the implementation described herein, the electrode takes up a portion of a rear surface of a cell 272.

The remainder of the rear surface of a cell 272 is formed from a reflective aperture layer 286 that forms the front surface of the optical cavity 274. The reflective aperture layer 286 is formed from a reflective material, such as a reflective metal or a stack of thin films forming a dielectric mirror. For each cell 272, an aperture is formed in the reflective aperture layer 286 to allow light to pass through. The electrode 282 for the cell is deposited in the aperture and over the material forming the reflective aperture layer 286, separated by another dielectric layer.

The remainder of the optical cavity 274 includes a light guide 288 positioned proximate the reflective aperture layer 286, and a second reflective layer 290 on a side of the light guide 288 opposite the reflective aperture layer 286. A series of light redirectors 291 are formed on the rear surface of the light guide, proximate the second reflective layer. The light redirectors 291 may be either diffuse or specular reflectors. One or more light sources 292, such as LEDs, inject light 294 into the light guide 288.

In an alternative implementation, an additional transparent substrate (not shown) is positioned between the light guide 288 and the light modulation array 270. In this implementation, the reflective aperture layer 286 is formed on the additional transparent substrate instead of on the surface of the light guide 288.

In operation, application of a voltage to the electrode 282 of a cell (for example, cell 272*b* or 272*c*) causes the light absorbing oil 280 in the cell to collect in one portion of the cell 272. As a result, the light absorbing oil 280 no longer obstructs the passage of light through the aperture formed in the reflective aperture layer 286 (see, for example, cells 272*b* and 272*c*). Light escaping the backlight at the aperture is then able to escape through the cell and through a corresponding color filter (for example, red, green or blue) in the set of color filters 276 to form a color pixel in an image. When the electrode 282 is grounded, the light absorbing oil 280 covers the aperture in the reflective aperture layer 286, absorbing any light 294 attempting to pass through it.

The area under which oil 280 collects when a voltage is applied to the cell 272 constitutes wasted space in relation to forming an image. This area is non-transmissive, whether a voltage is applied or not. Therefore, without the inclusion of the reflective portions of reflective apertures layer 286, this area absorbs light that otherwise could be used to contribute to the formation of an image. However, with the inclusion of the reflective aperture layer 286, this light, which otherwise would have been absorbed, is reflected back into the light guide 290 for future escape through a different aperture. The electrowetting-based light modulation array 270 is not the only example of a non-shutter-based MEMS modulator suitable for inclusion in the display apparatus described herein. Other forms of non-shutter-based MEMS modulators could likewise be controlled by various ones of the controller functions described herein without departing from the scope of this disclosure.

Figure 3A:
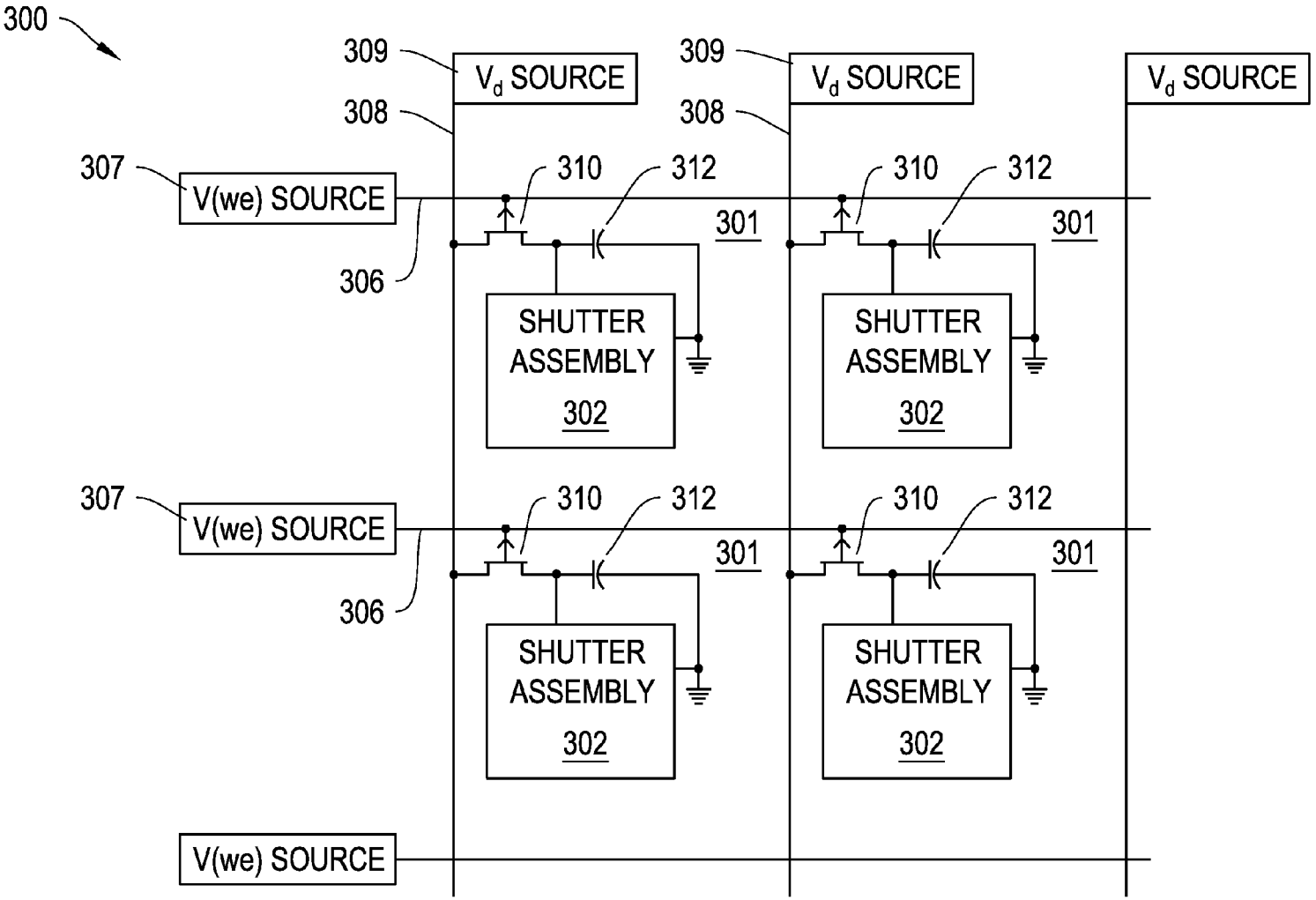
FIG. 3A shows a schematic diagram of an example control matrix.
Figure 3B:
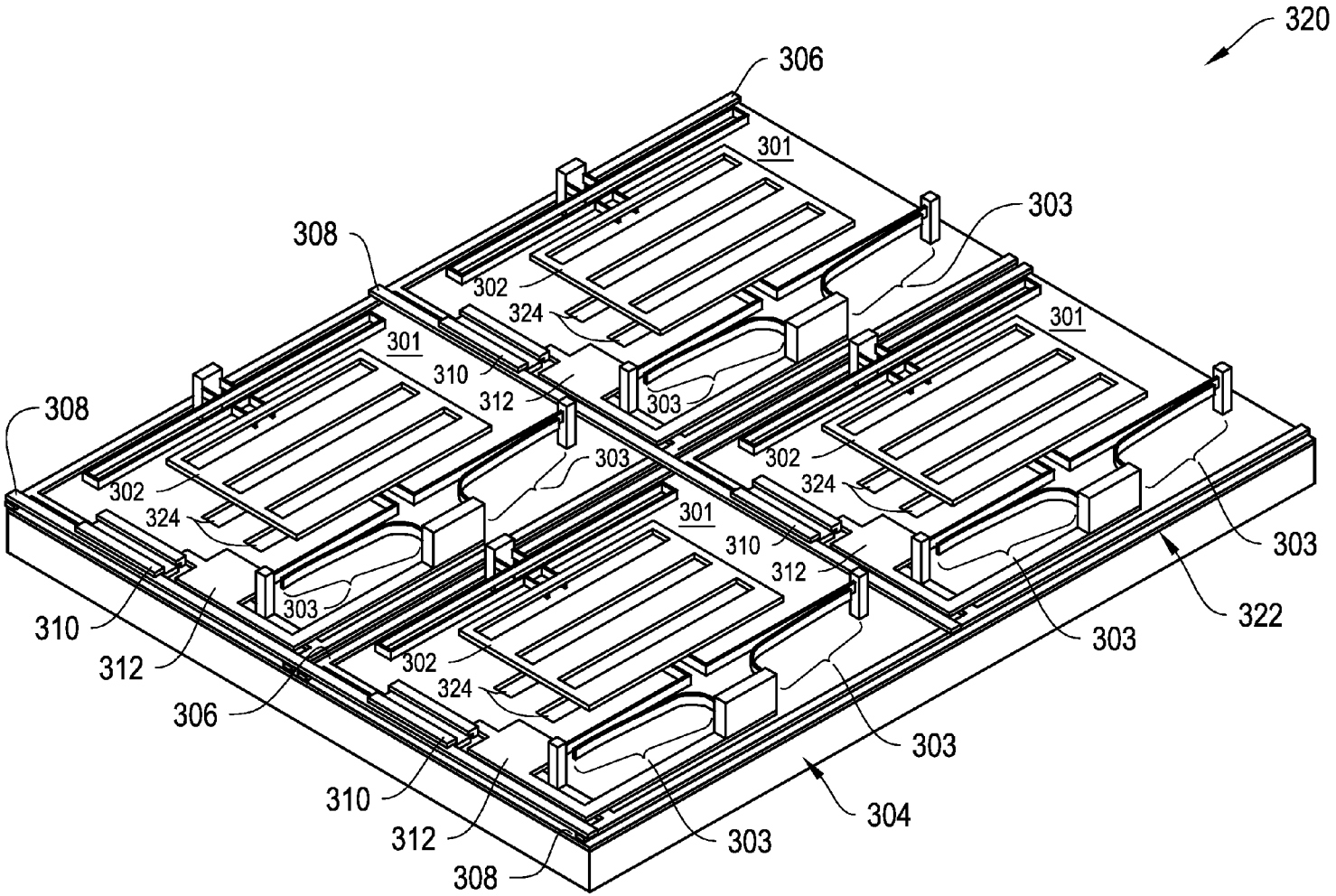
FIG. 3B shows a perspective view of an example array of shutter-based light modulators connected to the control matrix of FIG. 3A.

FIG. 3A shows a schematic diagram of an example control matrix 300. The control matrix 300 is suitable for controlling the light modulators incorporated into the MEMS-based display apparatus 100 of FIG. 1A. FIG. 3B shows a perspective view of an example array 320 of shutter-based light modulators connected to the control matrix 300 of FIG. 3A. The control matrix 300 may address an array of pixels 320 (the "array 320"). Each pixel 301 can include an elastic shutter assembly 302, such as the shutter assembly 200 of FIG. 2A, controlled by an actuator 303. Each pixel also can include an aperture layer 322 that includes apertures 324.

The control matrix 300 is fabricated as a diffused or thin-film-deposited electrical circuit on the surface of a substrate 304 on which the shutter assemblies 302 are formed. The control matrix 300 includes a scan-line interconnect 306 for each row of pixels 301 in the control matrix 300 and a data-interconnect 308 for each column of pixels 301 in the control matrix 300. Each scan-line interconnect 306 electrically connects a write-enabling voltage source 307 to the pixels 301 in a corresponding row of pixels 301. Each data interconnect 308 electrically connects a data voltage source 309 ("$V_d$ source") to the pixels 301 in a corresponding column of pixels. In the control matrix 300, the $V_d$ source 309 provides the majority of the energy to be used for actuation of the shutter assemblies 302. Thus, the data voltage source, $V_d$ source 309, also serves as an actuation voltage source.

Referring to FIGS. 3A and 3B, for each pixel 301 or for each shutter assembly 302 in the array of pixels 320, the control matrix 300 includes a transistor 310 and a capacitor 312. The gate of each transistor 310 is electrically connected to the scan-line interconnect 306 of the row in the array 320 in which the pixel 301 is located. The source of each transistor 310 is electrically connected to its corresponding data interconnect 308. The actuators 303 of each shutter assembly 302 include two electrodes. The drain of each transistor 310 is electrically connected in parallel to one electrode of the corresponding capacitor 312 and to one of the electrodes of the corresponding actuator 303. The other electrode of the capacitor 312 and the other electrode of the actuator 303 in shutter assembly 302 are connected to a common or ground potential. In alternate implementations, the transistors 310 can be replaced with semiconductor diodes and or metal-insulator-metal sandwich type switching elements.

In operation, to form an image, the control matrix 300 write-enables each row in the array 320 in a sequence by applying $V_{we}$ to each scan-line interconnect 306 in turn. For a write-enabled row, the application of $V_{we}$ to the gates of the transistors 310 of the pixels 301 in the row allows the flow of current through the data interconnects 308 through the transistors 310 to apply a potential to the actuator 303 of the shutter assembly 302. While the row is write-enabled, data voltages $V_d$ are selectively applied to the data interconnects 308. In implementations providing analog gray scale, the data voltage applied to each data interconnect 308 is varied in relation to the desired brightness of the pixel 301 located at the intersection of the write-enabled scan-line interconnect 306 and the data interconnect 308. In implementations providing digital control schemes, the data voltage is selected to be either a relatively low magnitude voltage (i.e., a voltage near ground) or to meet or exceed $V_{at}$ (the actuation threshold voltage). In response to the application of $V_{at}$ to a data interconnect 308, the actuator 303 in the corresponding shutter assembly actuates, opening the shutter in that shutter assembly 302. The voltage applied to the data interconnect 308 remains stored in the capacitor 312 of the pixel 301 even after the control matrix 300 ceases to apply $V_{we}$ to a row. Therefore, the voltage $V_{we}$ does not have to wait and hold on a row for times long enough for the shutter assembly 302 to actuate; such actuation can proceed after the write-enabling voltage has been removed from the row. The capacitors 312 also function as memory elements within the array 320, storing actuation instructions for the illumination of an image frame.

The pixels 301 as well as the control matrix 300 of the array 320 are formed on a substrate 304. The array 320 includes an aperture layer 322, disposed on the substrate 304, which includes a set of apertures 324 for respective pixels 301 in the array 320. The apertures 324 are aligned with the shutter assemblies 302 in each pixel. In some implementations, the substrate 304 is made of a transparent material, such as glass or plastic. In some other implementations, the substrate 304 is made of an opaque material, but in which holes are etched to form the apertures 324.

The shutter assembly 302 together with the actuator 303 can be made bi-stable. That is, the shutters can exist in at least two equilibrium positions (such as open or closed) with little or no power required to hold them in either position. More particularly, the shutter assembly 302 can be mechanically bi-stable. Once the shutter of the shutter assembly 302 is set in position, no electrical energy or holding voltage is required to maintain that position. The mechanical stresses on the physical elements of the shutter assembly 302 can hold the shutter in place.

The shutter assembly 302 together with the actuator 303 also can be made electrically bi-stable. In an electrically bi-stable shutter assembly, there exists a range of voltages below the actuation voltage of the shutter assembly, which if applied to a closed actuator (with the shutter being either open or closed), holds the actuator closed and the shutter in position, even if an opposing force is exerted on the shutter. The opposing force may be exerted by a spring such as the spring 207 in the shutter-based light modulator 200 depicted in FIG. 2A, or the opposing force may be exerted by an opposing actuator, such as an "open" or "closed" actuator.

The light modulator array 320 is depicted as having a single MEMS light modulator per pixel. Other implementations are possible in which multiple MEMS light modulators are provided in each pixel, thereby providing the possibility of more than just binary "on" or "off" optical states in each pixel. Certain forms of coded area division gray scale are possible where multiple MEMS light modulators in the pixel are provided, and where apertures 324, which are associated with each of the light modulators, have unequal areas.

In some other implementations, the roller-based light modulator 220, the light tap 250, or the electrowetting-based light modulation array 270, as well as other MEMS-based light modulators, can be substituted for the shutter assembly 302 within the light modulator array 320.

Figure 4A:
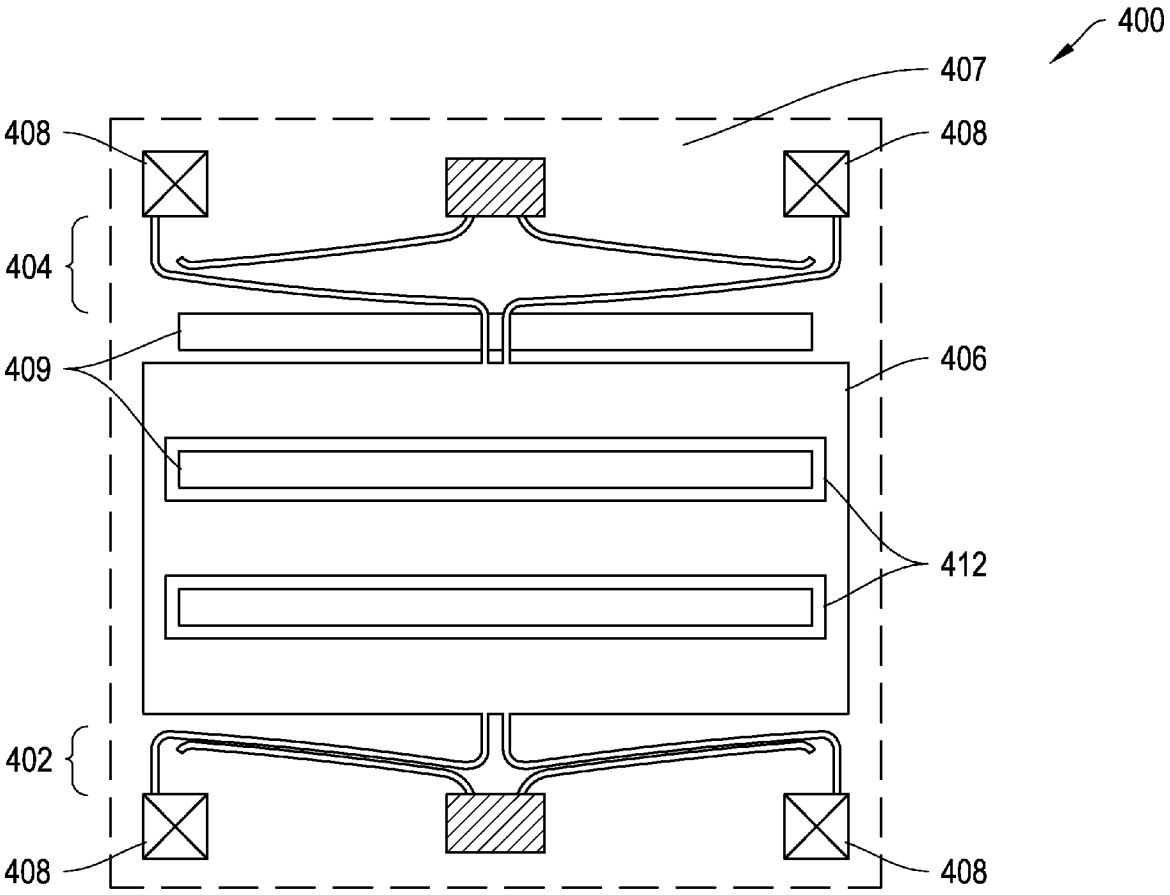
FIGS. 4A and 4B show views of an example dual actuator shutter assembly.
Figure 4B:
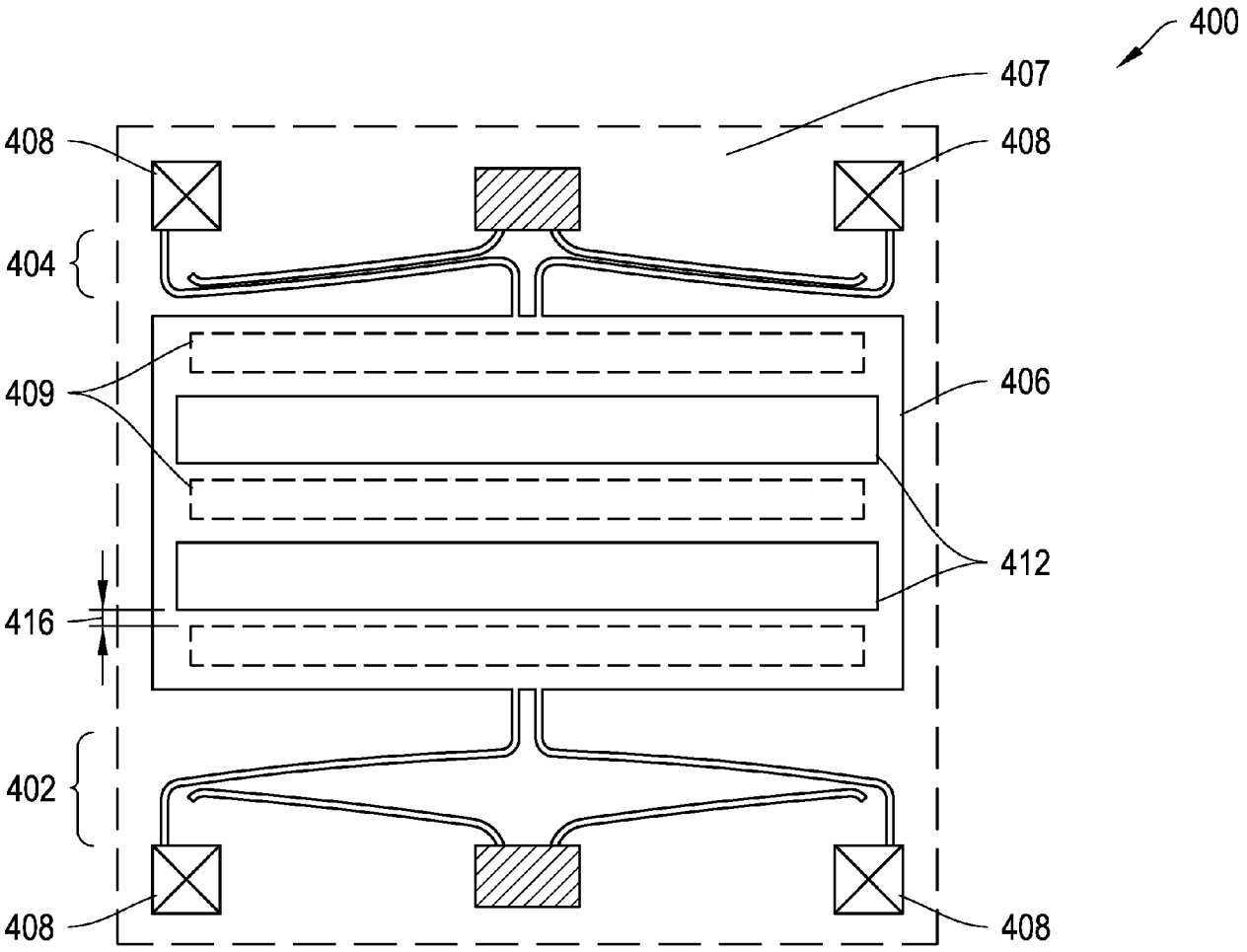

FIGS. 4A and 4B show views of an example dual actuator shutter assembly 400. The dual actuator shutter assembly 400, as depicted in FIG. 4A, is in an open state. FIG. 4B shows the dual actuator shutter assembly 400 in a closed state. In contrast to the shutter assembly 200, the shutter assembly 400 includes actuators 402 and 404 on either side of a shutter 406. Each actuator 402 and 404 is independently controlled. A first actuator, a shutter-open actuator 402, serves to open the shutter 406. A second opposing actuator, the shutter-close actuator 404, serves to close the shutter 406. Both of the actuators 402 and 404 are compliant beam electrode actuators. The actuators 402 and 404 open and close the shutter 406 by driving the shutter 406 substantially in a plane parallel to an aperture layer 407 over which the shutter is suspended. The shutter 406 is suspended a short distance over the aperture layer 407 by anchors 408 attached to the actuators 402 and 404. The inclusion of supports attached to both ends of the shutter 406 along its axis of movement reduces out of plane motion of the shutter 406 and confines the motion substantially to a plane parallel to the substrate. By analogy to the control matrix 300 of FIG. 3A, a control matrix suitable for use with the shutter assembly 400 might include one transistor and one capacitor for each of the opposing shutter-open and shutter-close actuators 402 and 404.

The shutter 406 includes two shutter apertures 412 through which light can pass. The aperture layer 407 includes a set of three apertures 409. In FIG. 4A, the shutter assembly 400 is in the open state and, as such, the shutter-open actuator 402 has been actuated, the shutter-close actuator 404 is in its relaxed position, and the centerlines of the shutter apertures 412 coincide with the centerlines of two of the aperture layer apertures 409. In FIG. 4B the shutter assembly 400 has been moved to the closed state and, as such, the shutter-open actuator 402 is in its relaxed position, the shutter-close actuator 404 has been actuated, and the light blocking portions of the shutter 406 are now in position to block transmission of light through the apertures 409 (depicted as dotted lines).

Each aperture has at least one edge around its periphery. For example, the rectangular apertures 409 have four edges. In alternative implementations in which circular, elliptical, oval, or other curved apertures are formed in the aperture layer 407, each aperture may have only a single edge. In some other implementations, the apertures need not be separated or disjoint in the mathematical sense, but instead can be connected. That is to say, while portions or shaped sections of the aperture may maintain a correspondence to each shutter, several of these sections may be connected such that a single continuous perimeter of the aperture is shared by multiple shutters.

In order to allow light with a variety of exit angles to pass through apertures 412 and 409 in the open state, it is advantageous to provide a width or size for shutter apertures 412 which is larger than a corresponding width or size of apertures 409 in the aperture layer 407. In order to effectively block light from escaping in the closed state, it is preferable that the light blocking portions of the shutter 406 overlap the apertures 409. FIG. 4B shows a predefined overlap 416 between the edge of light blocking portions in the shutter 406 and one edge of the aperture 409 formed in the aperture layer 407.

The electrostatic actuators 402 and 404 are designed so that their voltage-displacement behavior provides a bi-stable characteristic to the shutter assembly 400. For each of the shutter-open and shutter-close actuators there exists a range of voltages below the actuation voltage, which if applied while that actuator is in the closed state (with the shutter being either open or closed), will hold the actuator closed and the shutter in position, even after an actuation voltage is applied to the opposing actuator. The minimum voltage needed to maintain a shutter's position against such an opposing force is referred to as a maintenance voltage $V_m$.

Figure 5:
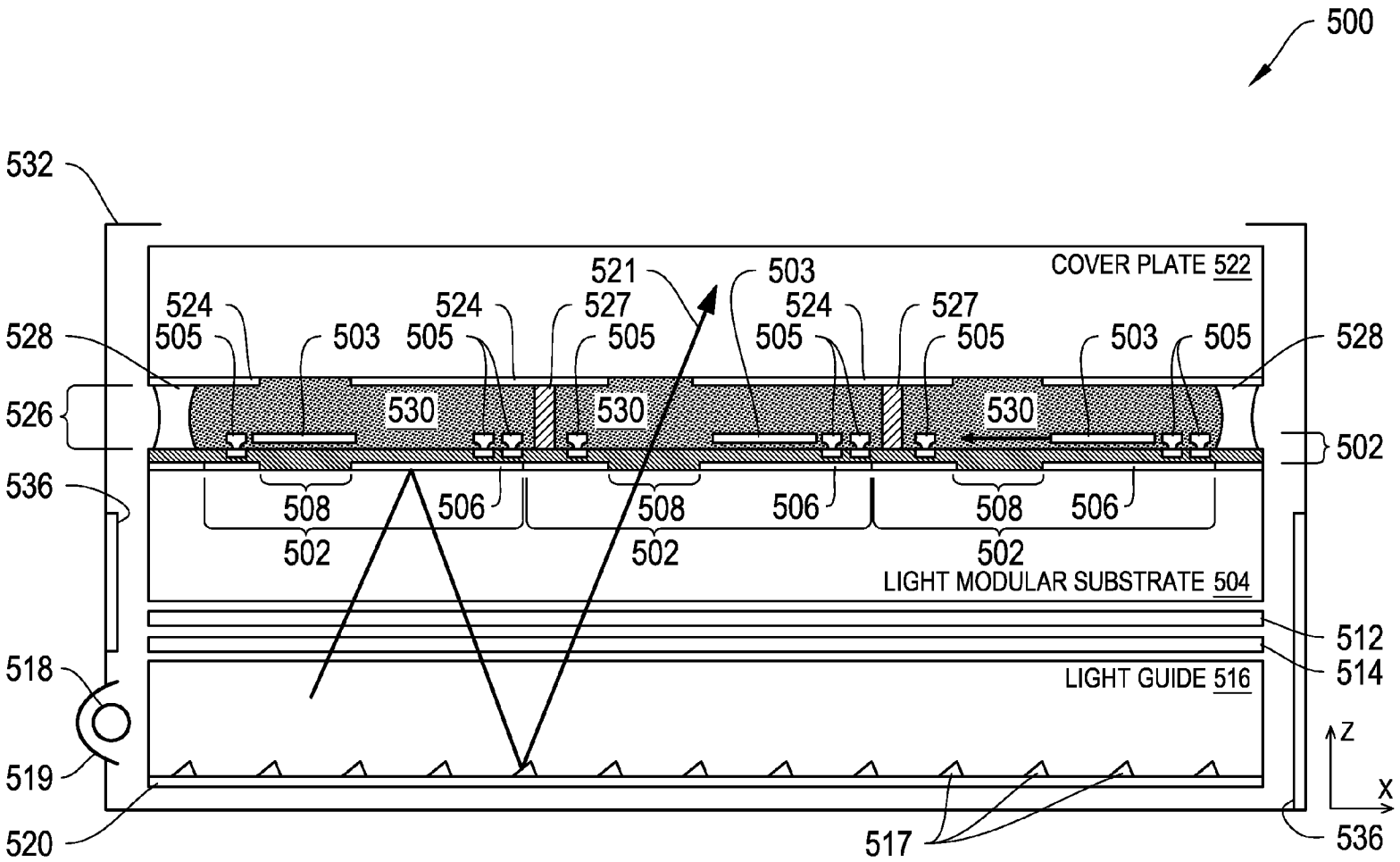
FIG. 5 shows a cross sectional view of an example display apparatus incorporating shutter-based light modulators.

FIG. 5 shows a cross sectional view of an example display apparatus 500 incorporating shutter-based light modulators (shutter assemblies) 502. Each shutter assembly 502 incorporates a shutter 503 and an anchor 505. Not shown are the compliant beam actuators which, when connected between the anchors 505 and the shutters 503, help to suspend the shutters 503 a short distance above the surface. The shutter assemblies 502 are disposed on a transparent substrate 504, such a substrate made of plastic or glass. A rear-facing reflective layer, reflective film 506, disposed on the substrate 504 defines a plurality of surface apertures 508 located beneath the closed positions of the shutters 503 of the shutter assemblies 502. The reflective film 506 reflects light not passing through the surface apertures 508 back towards the rear of the display apparatus 500. The reflective aperture layer 506 can be a fine-grained metal film without inclusions formed in thin film fashion by a number of vapor deposition techniques including sputtering, evaporation, ion plating, laser ablation, or chemical vapor deposition (CVD). In some other implementations, the rear-facing reflective layer 506 can be formed from a mirror, such as a dielectric mirror. A dielectric mirror or can be fabricated as a stack of dielectric thin films which alternate between materials of high and low refractive index. The vertical gap which separates the shutters 503 from the reflective film 506, within which the shutter is free to move, is in the range of 0.5 to 10 microns. The magnitude of the vertical gap is preferably less than the lateral overlap between the edge of shutters 503 and the edge of apertures 508 in the closed state, such as the overlap 416 depicted in FIG. 4B.

The display apparatus 500 includes an optional diffuser 512 and/or an optional brightness enhancing film 514 which separate the substrate 504 from a planar light guide 516. The light guide 516 includes a transparent, i.e., glass or plastic material. The light guide 516 is illuminated by one or more light sources 518, forming a backlight. The light sources 518 can be, for example, and without limitation, incandescent lamps, fluorescent lamps, lasers or LEDs. A reflector 519 helps direct light from lamp 518 towards the light guide 516. A front-facing reflective film 520 is disposed behind the backlight 516, reflecting light towards the shutter assemblies 502. Light rays such as ray 521 from the backlight that do not pass through one of the shutter assemblies 502 will be returned to the backlight and reflected again from the film 520. In this fashion light that fails to leave the display apparatus 500 to form an image on the first pass can be recycled and made available for transmission through other open apertures in the array of shutter assemblies 502. Such light recycling has been shown to increase the illumination efficiency of the display.

The light guide 516 includes a set of geometric light redirectors or prisms 517 which re-direct light from the lamps 518 towards the apertures 508 and hence toward the front of the display. The light redirectors 517 can be molded into the plastic body of light guide 516 with shapes that can be alternately triangular, trapezoidal, or curved in cross section. The density of the prisms 517 generally increases with distance from the lamp 518.

In some implementations, the aperture layer 506 can be made of a light absorbing material, and in alternate implementations the surfaces of shutter 503 can be coated with either a light absorbing or a light reflecting material. In some other implementations, the aperture layer 506 can be deposited directly on the surface of the light guide 516. In some implementations, the aperture layer 506 need not be disposed on the same substrate as the shutters 503 and anchors 505 (such as in the MEMS-down configuration described below).

In some implementations, the light sources 518 can include lamps of different colors, for instance, the colors red, green and blue. A color image can be formed by sequentially illuminating images with lamps of different colors at a rate sufficient for the human brain to average the different colored images into a single multi-color image. The various color-specific images are formed using the array of shutter assemblies 502. In another implementation, the light source 518 includes lamps having more than three different colors. For example, the light source 518 may have red, green, blue and white lamps, or red, green, blue and yellow lamps. In some other implementations, the light source 518 may include cyan, magenta, yellow and white lamps, red, green, blue and white lamps. In some other implementations, additional lamps may be included in the light source 518. For example, if using five colors, the light source 518 may include red, green, blue, cyan and yellow lamps. In some other implementations, the light source 518 may include white, orange, blue, purple and green lamps or white, blue, yellow, red and cyan lamps. If using six colors, the light source 518 may include red, green, blue, cyan, magenta and yellow lamps or white, cyan, magenta, yellow, orange and green lamps.

A cover plate 522 forms the front of the display apparatus 500. The rear side of the cover plate 522 can be covered with a black matrix 524 to increase contrast. In alternate implementations the cover plate includes color filters, for instance distinct red, green, and blue filters corresponding to different ones of the shutter assemblies 502. The cover plate 522 is supported a predetermined distance away from the shutter assemblies 502 forming a gap 526. The gap 526 is maintained by mechanical supports or spacers 527 and/or by an adhesive seal 528 attaching the cover plate 522 to the substrate 504.

The adhesive seal 528 seals in a fluid 530. The fluid 530 is engineered with viscosities preferably below about 10 centipoise and with relative dielectric constant preferably above about 2.0, and dielectric breakdown strengths above about $10^4$ V/cm. The fluid 530 also can serve as a lubricant. In some implementations, the fluid 530 is a hydrophobic liquid with a high surface wetting capability. In alternate implementations, the fluid 530 has a refractive index that is either greater than or less than that of the substrate 504.

Displays that incorporate mechanical light modulators can include hundreds, thousands, or in some cases, millions of moving elements. In some devices, every movement of an element provides an opportunity for static friction to disable one or more of the elements. This movement is facilitated by immersing all the parts in a fluid (also referred to as fluid 530) and sealing the fluid (such as with an adhesive) within a fluid space or gap in a MEMS display cell. The fluid 530 is usually one with a low coefficient of friction, low viscosity, and minimal degradation effects over the long term. When the MEMS-based display assembly includes a liquid for the fluid 530, the liquid at least partially surrounds some of the moving parts of the MEMS-based light modulator. In some implementations, in order to reduce the actuation voltages, the liquid has a viscosity below 70 centipoise. In some other implementations, the liquid has a viscosity below 10 centipoise. Liquids with viscosities below 70 centipoise can include materials with low molecular weights: below 4000 grams/mole, or in some cases below 400 grams/mole. Fluids 530 that also may be suitable for such implementations include, without limitation, de-ionized water, methanol, ethanol and other alcohols, paraffins, olefins, ethers, silicone oils, fluorinated silicone oils, or other natural or synthetic solvents or lubricants. Useful fluids can be polydimethylsiloxanes (PDMS), such as hexamethyldisiloxane and octamethyltrisiloxane, or alkyl methyl siloxanes such as hexylpentamethyldisiloxane. Useful fluids can be alkanes, such as octane or decane. Useful fluids can be nitroalkanes, such as nitromethane. Useful fluids can be aromatic compounds, such as toluene or diethylbenzene. Useful fluids can be ketones, such as butanone or methyl isobutyl ketone. Useful fluids can be chlorocarbons, such as chlorobenzene. Useful fluids can be chlorofluorocarbons, such as dichlorofluoroethane or chlorotrifluoroethylene. Other fluids considered for these display assemblies include butyl acetate and dimethylformamide. Still other useful fluids for these displays include hydro fluoro ethers, perfluoropolyethers, hydro fluoro poly ethers, pentanol, and butanol. Example suitable hydro fluoro ethers include ethyl nonafluorobutyl ether and 2-trifluoromethyl-3-ethoxydodecafluorohexane.

A sheet metal or molded plastic assembly bracket 532 holds the cover plate 522, the substrate 504, the backlight and the other component parts together around the edges. The assembly bracket 532 is fastened with screws or indent tabs to add rigidity to the combined display apparatus 500. In some implementations, the light source 518 is molded in place by an epoxy potting compound. Reflectors 536 help return light escaping from the edges of the light guide 516 back into the light guide 516. Not depicted in FIG. 5 are electrical interconnects which provide control signals as well as power to the shutter assemblies 502 and the lamps 518.

In some other implementations, the roller-based light modulator 220, the light tap 250, or the electrowetting-based light modulation array 270, as depicted in FIGS. 2A-2D, as well as other MEMS-based light modulators, can be substituted for the shutter assemblies 502 within the display apparatus 500.

The display apparatus 500 is referred to as the MEMS-up configuration, wherein the MEMS based light modulators are formed on a front surface of the substrate 504, i.e., the surface that faces toward the viewer. The shutter assemblies 502 are built directly on top of the reflective aperture layer 506. In an alternate implementation, referred to as the MEMS-down configuration, the shutter assemblies are disposed on a substrate separate from the substrate on which the reflective aperture layer is formed. The substrate on which the reflective aperture layer is formed, defining a plurality of apertures, is referred to herein as the aperture plate. In the MEMS-down configuration, the substrate that carries the MEMS-based light modulators takes the place of the cover plate 522 in the display apparatus 500 and is oriented such that the MEMS-based light modulators are positioned on the rear surface of the top substrate, i.e., the surface that faces away from the viewer and toward the light guide 516. The MEMS-based light modulators are thereby positioned directly opposite to and across a gap from the reflective aperture layer 506. The gap can be maintained by a series of spacer posts connecting the aperture plate and the substrate on which the MEMS modulators are formed. In some implementations, the spacers are disposed within or between each pixel in the array. The gap or distance that separates the MEMS light modulators from their corresponding apertures is preferably less than 10 microns, or a distance that is less than the overlap between shutters and apertures, such as overlap 416.

Figure 6:
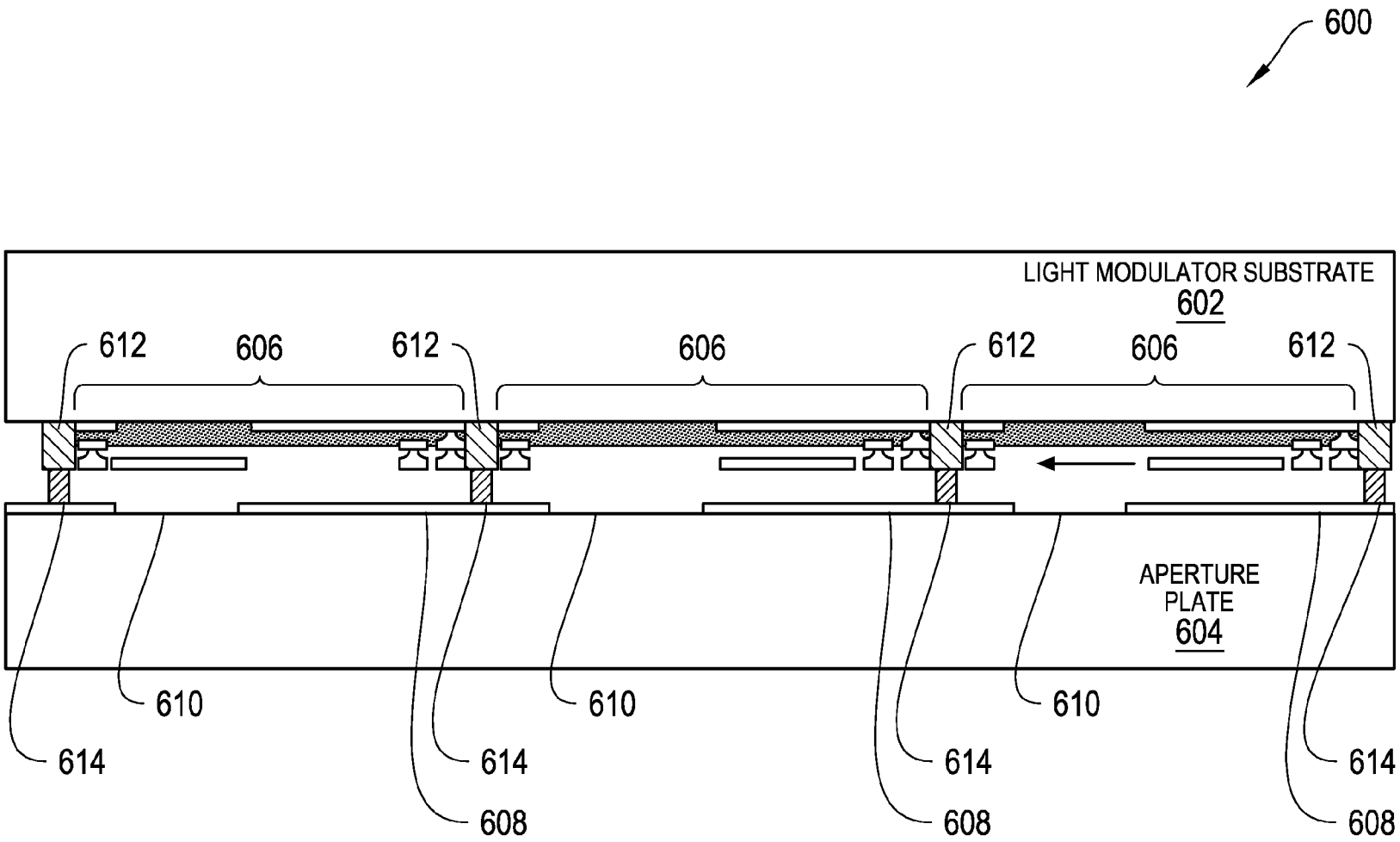
FIG. 6 shows a cross sectional view of an example light modulator substrate and an example aperture plate for use in a MEMS-down configuration of a display.

FIG. 6 shows a cross sectional view of an example light modulator substrate and an example aperture plate for use in a MEMS-down configuration of a display. The display assembly 600 includes a modulator substrate 602 and an aperture plate 604. The display assembly 600 also includes a set of shutter assemblies 606 and a reflective aperture layer 608. The reflective aperture layer 608 includes apertures 610. A predetermined gap or separation between the modulator substrates 602 and the aperture plate 604 is maintained by the opposing set of spacers 612 and 614. The spacers 612 are formed on or as part of the modulator substrate 602. The spacers 614 are formed on or as part of the aperture plate 604. During assembly, the two substrates 602 and 604 are aligned so that spacers 612 on the modulator substrate 602 make contact with their respective spacers 614.

The separation or distance of this illustrative example is 8 microns. To establish this separation, the spacers 612 are 2 microns tall and the spacers 614 are 6 microns tall. Alternately, both spacers 612 and 614 can be 4 microns tall, or the spacers 612 can be 6 microns tall while the spacers 614 are 2 microns tall. In fact, any combination of spacer heights can be employed as long as their total height establishes the desired separation H12.

Providing spacers on both of the substrates 602 and 604, which are then aligned or mated during assembly, has advantages with respect to materials and processing costs. The provision of a very tall, such as larger than 8 micron spacers, can be costly as it can require relatively long times for the cure, exposure, and development of a photo-imageable polymer. The use of mating spacers as in display assembly 600 allows for the use of thinner coatings of the polymer on each of the substrates.

In another implementation, the spacers 612 which are formed on the modulator substrate 602 can be formed from the same materials and patterning blocks that were used to form the shutter assemblies 606. For instance, the anchors employed for shutter assemblies 606 also can perform a function similar to spacer 612. In this implementation, a separate application of a polymer material to form a spacer would not be required and a separate exposure mask for the spacers would not be required.

Figure 7:
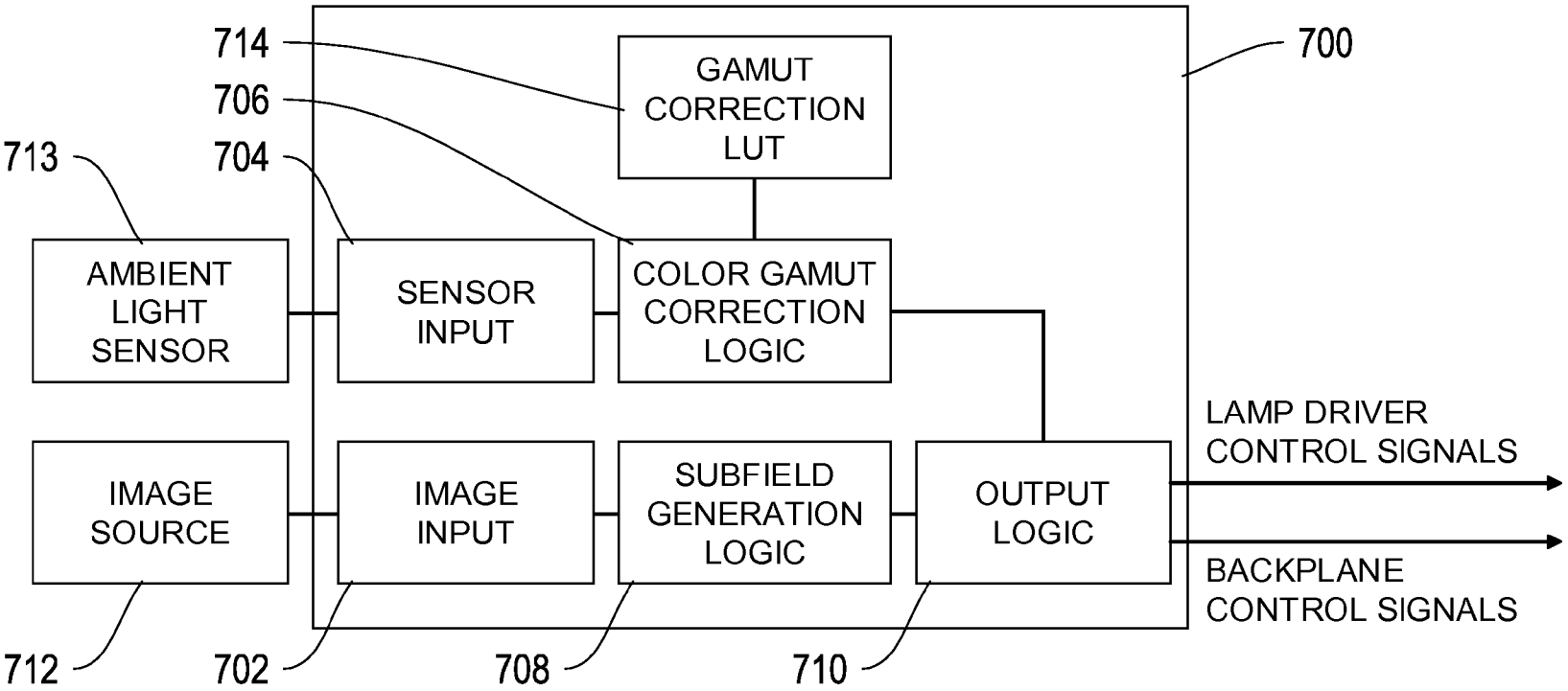
FIG. 7 shows a block diagram of an example display controller.

FIG. 7 shows a block diagram of an example display controller 700. The display controller 700 is configured to be used, in some implementations, as the controller 134 shown in FIG. 1B. The display controller 700 is configured to vary the display of images based on the ambient lighting conditions experienced by the display it controls. The display controller 700 includes an image input 702, a sensor input 704, color gamut correction logic 706, subfield generation logic 708, output logic 710, and a memory that stores a LUT 714. Together these components carry out a process, such as the process for controlling a display backlight in response to ambient light data 800 shown in FIG. 8. As such, the function of each of the logic components is described further below in relation to FIG. 8.

The display controller 700 can be implemented in a variety of architectures. In some implementations, the display controller 700 includes a programmable microprocessor configured to execute computer executable instructions stored on a computer readable medium incorporated into or coupled to the microprocessor. When executed, the computer executable instructions cause the microprocessor to carry out the processes described herein with respect to the various logic components of the display controller 700. In some other implementations, some or all of the logic components of the display controller 700 are implemented as an integrated circuit, for example, as part of an application specific integrated circuit (ASIC) or field programmable gate array (FPGA). Similarly, some of the logic components of the display controller 700 can be implemented by a digital signal processor (DSP). In some implementations, the displayer is implemented as a microprocessor configured to issue instructions to an ASIC, FPGA, DSP, or to another microprocessor.

The image input 702 may be any type of electronic input. In some implementations, the image input 702 is an external data port for receiving image data from an outside device, such as an HDMI port, a VGA port, a DVI port, a mini-DisplayPort, a coaxial cable port, or a set of component or composite video cable ports. The image input 702 also may include a transceiver for receiving image data wirelessly. In some other implementations, the image input 702 includes one or more internal data ports. Such data ports may be configured to receive display data over a data bus or dedicated cable from a memory device, a host processor, a transceiver, or any of the external data ports described above.

The sensor input 704 can likewise take on a variety of configurations in various implementations. In some implementations, the sensor input 704 can be an external data port, such as a Universal Serial Bus (USB), mini-USB, micro-USB, FIREWIRE™, or LIGHTNING™ port. In some implementations, the sensor input 704 takes the form of an internal data port, for example a flex cable connector or a data port coupled to a data bus which is further coupled to a host processor, a transceiver, or other data port.

Figure 8:
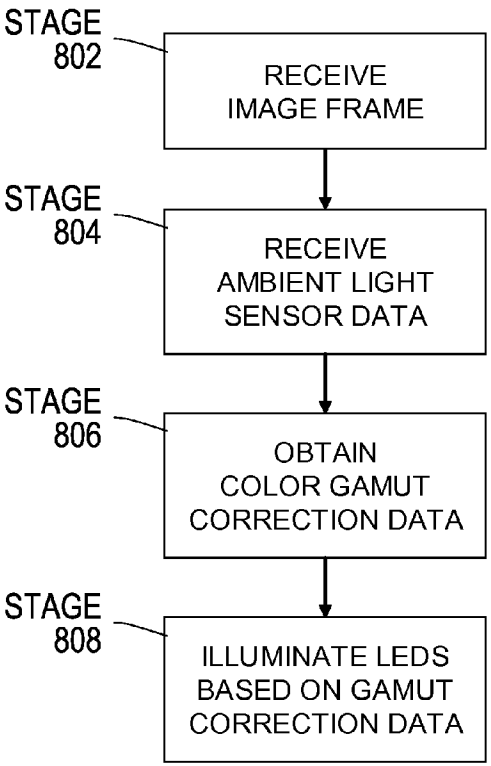
FIG. 8 shows a flow diagram of an example process for controlling a display backlight in response to ambient light data.

FIG. 8 shows a flow diagram of an example process 800 for controlling a display backlight in response to ambient light data. As set forth above, the process 800 may be implemented by the display controller 700 shown in FIG. 7. The process 800 includes receiving an image frame (stage 802), receiving ambient light sensor data (stage 804), obtaining color gamut correction data (stage 806) and illuminating display LEDs based on the obtained color gamut correction data (stage 808).

Referring to FIGS. 7 and 8, the process 800, begins, in some implementations, by receiving an image frame (stage 802). The image frame is received by the image input 702 of the display controller 700. The image input 702 may receive the image from an image source 712, such as a memory of a host device in which the display is incorporated, or from a transceiver configured to receive image data over a wired or wireless connection. The image data indicates for each pixel of the display a set of primary color (such as red, green, and blue) intensity values, which, when combined, form a desired color for the respective pixels. The image data assumes, and in some cases explicitly identifies, a color gamut with which the image will be displayed. Suitable color gamuts include, without limitation, the sRGB and Adobe RGB color gamuts. This color gamut is typically smaller than the native color gamut of the display, particularly when the display includes highly saturated light sources, such as colored LEDs. The native color gamut of a display is the color gamut that would be produced if the display were to use the fully saturated colors of its light sources, without any color mixing, as the display primaries.

The process 800 also includes the sensor input 704 of the display controller 700 receiving ambient light sensor data (stage 804). The sensor input 704 may receive the sensor data before, concurrently with, or after the image input 702 receives the image data (stage 802). The sensor data is received directly, or indirectly from an ambient light sensor 713. In one implementation, the ambient light sensor 713 detects and outputs a single illuminance value indicative of the overall level of ambient light. In some other implementations, the sensor data includes two or more values corresponding to the illuminance of two or more different colors within the ambient light.

After receiving the ambient light sensor data (stage 804), the process 800 continues with obtaining color gamut correction data (stage 806) and illuminating LEDs based on the obtained color gamut correction data (stage 808). These remaining stages of the process 800 may be more readily appreciated in view of FIG. 9.

Figure 9:
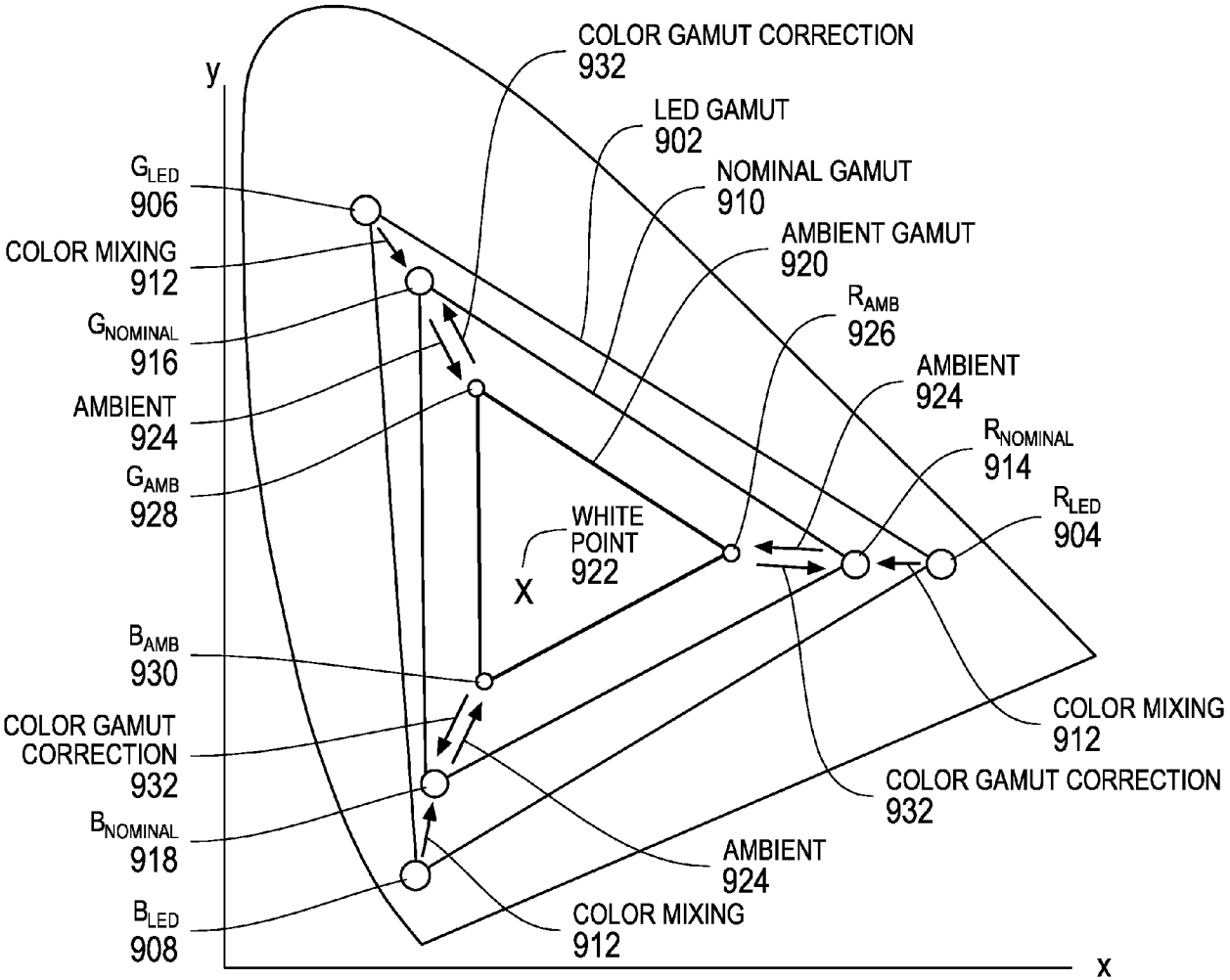
FIG. 9 shows an example color space diagram illustrating features of the process shown in FIG. 8.

FIG. 9 shows an example color space diagram 900 illustrating features of the process shown in FIG. 8. Referring to FIGS. 7-9, the color space diagram 900 is an xy chromaticity diagram associated with the CIE 1931 (Commission Internationale de l'Eclairage) XYZ color. It includes three triangles associated with respective color gamuts. The largest triangle 902, labeled LED GAMUT, represents display's native color gamut, including the range of colors a display could generate if it used the fully saturated colors output by an example set of typical red, green, and blue LEDs used in displays. The chromaticities of each these LEDs are labeled in the color space diagram 900 as $R_{LED}$ 904, $G_{LED}$ 906, and $B_{LED}$ 908, respectively.

Most images, however, are encoded based on a more limited color gamut (for example, sRGB or Adobe RGB). It is this more limited color gamut that most displays attempt to reproduce. The color gamut intended to be reproduced by the display is referred to herein as the "nominal color gamut" of the display. The primary colors associated with the nominal color gamut are referred to herein as "nominal primary colors" or "nominal primaries." The color space diagram 900 represents the display's nominal color gamut with the intermediate sized triangle, labeled NOMINAL GAMUT 910.

Displays with larger native color gamuts generate the nominal primaries by illuminating LEDs of multiple colors simultaneously, though in some implementations, other types of light sources may be employed. This mixing of multiple LED color outputs results in the less saturated colors of the nominal primary colors. This desaturation is depicted in FIG. 9 by the arrows 912 leading from the LED primary colors $R_{LED}$ 904, $G_{LED}$ 906, and $B_{LED}$ 908 to the nominal primaries $R_{NOMINAL}$ 914, $G_{NOMINAL}$ 916, and $B_{NOMINAL}$ 918, resulting in a shift from a color gamut associated with the LED GAMUT triangle 902 to a gamut associated with the NOMINAL GAMUT triangle 910.

Ambient light serves to further desaturate the light emitted by the display apparatus, resulting in an even smaller color gamut, depicted by the smallest triangle (labeled AMBIENT GAMUT 920). Conceptually, the generally white light of the ambient reflects off of the surface of the display, mixing with and desaturating the primary colors of the display's nominal gamut. This results in a viewer perceiving the nominal primary colors as being closer to the gamut's white point 922 and the overall color gamut as being more limited. This desaturation is depicted in FIG. 9 by the arrows 924 leading from the nominal primaries $R_{NOMINAL}$ 914, $G_{NOMINAL}$ 916, and $B_{NOMINAL}$ 918 to the primaries $R_{AMB}$ 926, $G_{AMB}$ 928, and $B_{AMB}$ 930, which correspond to the perceived primary colors given the ambient environment, referred to as "perceived primaries."

To account for this desaturation, the process 800 includes obtaining color gamut correction data (stage 806) tailored to the ambient light conditions. This process stage is carried out in some implementations by the color gamut correction logic 706 of the display controller 700. More particularly, based on the ambient lighting levels detected by one or more ambient light sensors 713 (shown in FIG. 7), the color gamut correction logic 706 outputs new primary color mixing parameters for use in the detected ambient light conditions. As ambient light increases, the color mixing parameters call for less color mixing, generating primary colors having chromaticities that are closer to the fully saturated chromaticities of the respective display LEDs, at least partially offsetting the desaturation caused by the ambient light. This "resaturation" is depicted in FIG. 9 by the arrows 932 pointing from the perceived primaries 926, 928 and 930 out towards the nominal primaries 914, 916 and 918 resulting in a shift from a perceived color gamut associated with the AMBIENT GAMUT triangle 920 back to, or at least towards, a gamut associated with the NOMINAL GAMUT triangle 910.

In some implementations, the color gamut correction logic 706 dynamically calculates a degree of resaturation based on a detected current ambient lighting level. In some other implementations, the color gamut correction logic 706 stores a gamut correction look-up table (LUT) 714 populated with pairs of ambient lighting level ranges and corresponding relative LED intensity levels. The gamut correction LUT 714 can be populated during a calibration process for the display, during manufacture, in which the display is exposed to a variety of ambient lighting conditions and desirable levels of resaturation are determined experimentally.

In some implementations, the display controller 700 is configured to generate images using more than three primary colors. For example, in some implementations, the display controller is configured to generate images using an additional white or yellow subfield. In such implementations, the color gamut correction logic 706 outputs additional color mixing parameters associated with the generation of the fourth primary color based on the detected ambient light condition.

Table 1 shows an example LUT suitable for use as the color gamut correction LUT 714. It includes a series of entries corresponding to respective ambient light levels. The ambient light levels may be specific light levels or non-overlapping ranges of light levels. In association with each ambient light level entry, the LUT stores an intensity value tuple for each primary color generated by the display. Each tuple includes an intensity value for each light source used by the display in generating the respective primary colors.

TABLE 1

Example Color Gamut Correction LUT

| Ambient Level | Red | Green | Blue | White |
|---|---|---|---|---|
| Level 1 | $[R_1, G_1, B_1, W_1]$ | $[R_2, G_2, B_2, W_2]$ | $[R_3, G_3, B_3, W_3]$ | $[R_4, G_4, B_4, W_4]$ |
| Level 2 | $[R_5, G_5, B_5, W_5]$ | $[R_6, G_6, B_6, W_6]$ | $[R_7, G_7, B_7, W_7]$ | $[R_8, G_8, B_8, W_8]$ |
| . . . | . . . | . . . | . . . | . . . |
| . . . | . . . | . . . | . . . | . . . |
| Level N | $[R_{(4(n-1)+1)}, G_{(4(n-1)+1)}, B_{(4(n-1)+1)}, W_{(4(n-1)+1)}]$ | $[R_{(4(n-1)+2)}, G_{(4(n-1)+2)}, B_{(4(n-1)+2)}, W_{(4(n-1)+2)}]$ | $[R_{(4(n-1)+3)}, G_{(4(n-1)+3)}, B_{(4(n-1)+3)}, W_{(4(n-1)+3)}]$ | $[R_{(4(n-1)+4)}, G_{(4(n-1)+4)}, B_{(4(n-1)+4)}, W_{(4(n-1)+4)}]$ |

In some implementations, the color gamut correction logic 706 outputs color mixing parameters intended to achieve a scaled version of the display's nominal color gamut. That is, the color mixing parameters output by the color gamut correction logic 706, when utilized, result in a color gamut that has substantially the same shape and white points as the nominal color gamut. Moreover, in some such implementations, the color mixing parameters, while adjusting the output intensities of one or more color LEDs, are not intended to increase the relative intensity or brightness of any particular primary color with respect to the other primary colors. In some implementations, the new mixing parameters merely result in different primary chromaticities, enlarging the display's perceived color gamut. In some implementations, the color mixing parameters also adjust the brightness of all generated primary colors proportionally, increasing the display's overall brightness without further affecting the chromaticities of the primary colors or the shape of the display's perceived color gamut. Brightness adjustment data can be stored in a separate LUT, or it can be integrated into the color gamut correction LUT 714. As such, illuminating the display with the new color mixing parameters in such implementations does not alter the white point of the display's color gamut.

In some implementations, in which the received ambient light sensor data includes information about the chromaticity of the ambient light, the gamut correction logic 706 may output new color mixing parameters that help compensate for any color imbalances in the detected ambient environment. In some such implementations, the color mixing parameters may result in a shift in the display's white point in addition to changing the size of its perceived color gamut.

The above process is directed to resaturating the color gamut of a display in a high ambient light environment. A corresponding process can be employed to desaturate the generated display primaries in response to a later detection of decreased ambient light levels.

Using the new color mixing parameters, the output logic 710 of the display controller 700 illuminates the display LEDs to reproduce the image frame (stage 808). In some implementations, the output logic 710 causes the LEDs to be illuminated according to a FSC color formation process, in which subfields associated with each generated primary (i.e., the colors resulting from the color mixing parameters output by the gamut correction logic 706), are displayed sequentially according to an output sequence. The color subfields are derived by the subfield generation logic 708 of the display controller 700 based on the received image data. In some implementations, the subfield generation logic 708 is further configured to generate a plurality of subframes for each of the color subfields to implement a time division gray scale scheme. In some implementations, the new color mixing parameters are selected such that the image data need not be modified based on the change to the generated primaries.

In some implementations, the output logic 710 of the display controller 700 implements content adaptive backlight control (CABC) based on the color subfields generated by the subfield generation logic 708. CABC includes identifying a color gamut that is even further restricted than the display's nominal color gamut. A CABC modified color gamut is typically limited by the greatest degree of saturation needed to display the colors indicated in an input image frame. Thus, in some implementations, and particularly useful for implementations utilizing CABC, the color gamut correction logic 706 can output relative primary color adjustment values, instead of absolute color mixing parameters. For example, the color gamut correction logic 706 may direct the output logic to reduce its color mixing by a percentage value based on the detected ambient light levels.

In some implementations, the output logic 710 may adjust the output of the display data in additional ways based on detected ambient light levels. For example, in higher ambient light environments, it becomes more difficult for the human visual system (HVS) to detect small gradations in color. As such, in implementations of the display controller 700 that implement a time division gray scale scheme, the output logic 710 may adjust the number of subframes used to reproduce each color subfield based on the current ambient light conditions. In general, the output logic 710 reduces the number of subframes used as ambient light levels increase, and increases the number of subframes used as ambient light levels decrease.

Figure 10:
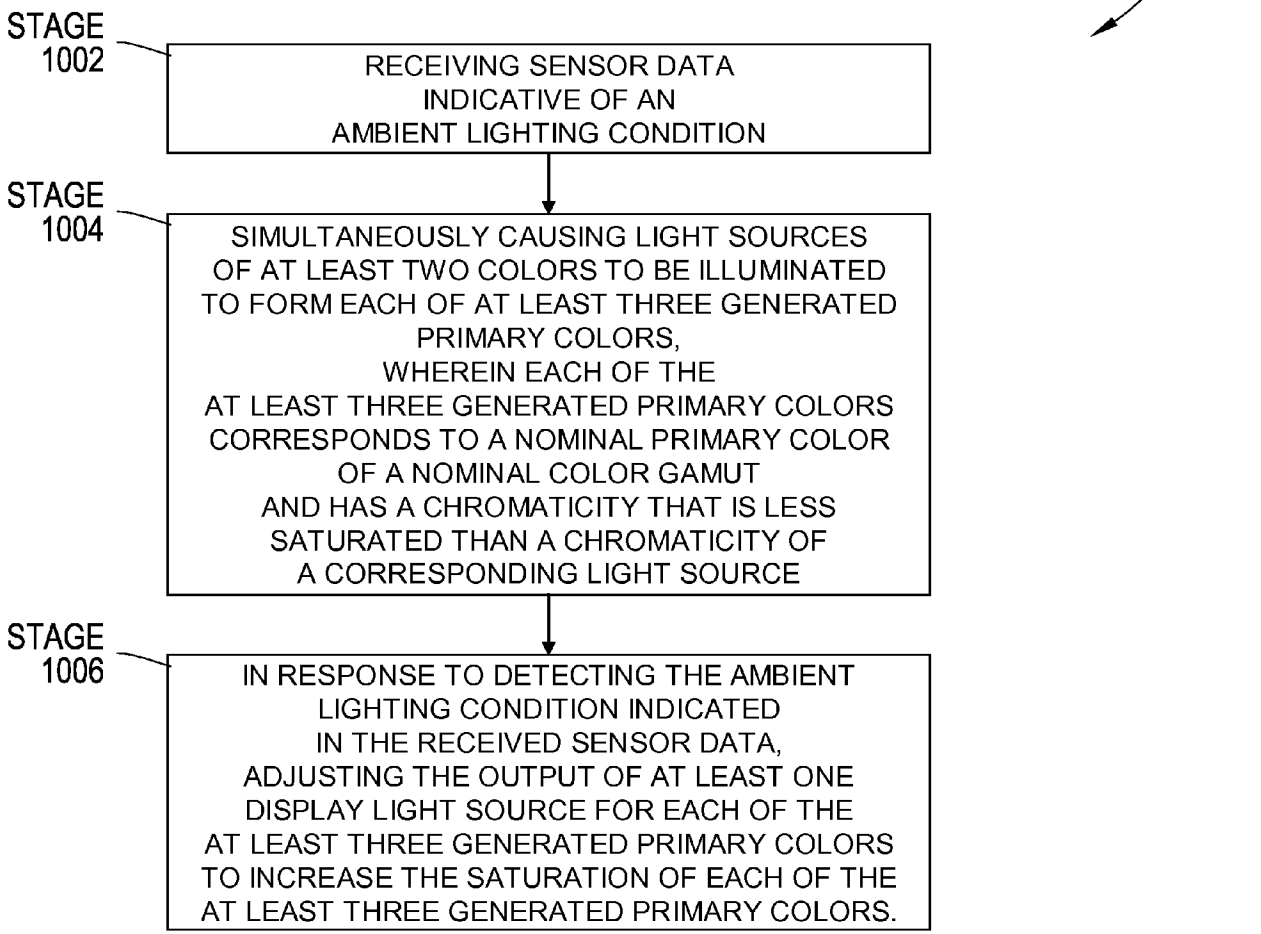
FIG. 10 shows a flow diagram of another example process for controlling a display backlight in response to ambient light data.

FIG. 10 shows a flow diagram of another example process 1000 for controlling a display backlight in response to ambient light data. The process 1000 is similar to the process 800 shown in FIG. 8. The process 1000 includes receiving sensor data indicative of an ambient lighting condition (stage 1002). In some implementation, the data indicative of the ambient lighting condition includes a total illuminace level, without discriminating between the color components of the ambient light. In some other implementations, the received sensor data also includes data indicative of the relative intensities of the component colors of the ambient light.

Next, light sources of at least two colors are illuminated to form each of at least three generated primary colors (stage 1004). The at least three generated primary colors can include, without limitation, red, green, and blue; red, green, blue, and white; red, green, blue and yellow; cyan, yellow, and magenta; or cyan, yellow, magenta and white. Each of the at least three generated primary colors corresponds to a nominal primary color of a nominal color gamut and has a chromaticity that is less saturated than a chromaticity of a corresponding light source.

In response to detecting the ambient lighting condition indicated in the received sensor data, the output of at least one display light source is adjusted for each of the at least three generated primary colors (stage 1006). Doing so increases the saturation of each of the at least three generated primary colors. As a result, the perceived color gamut of the display apparatus more closely resembles the nominal color gamut under the ambient lighting condition.

Figure 11:
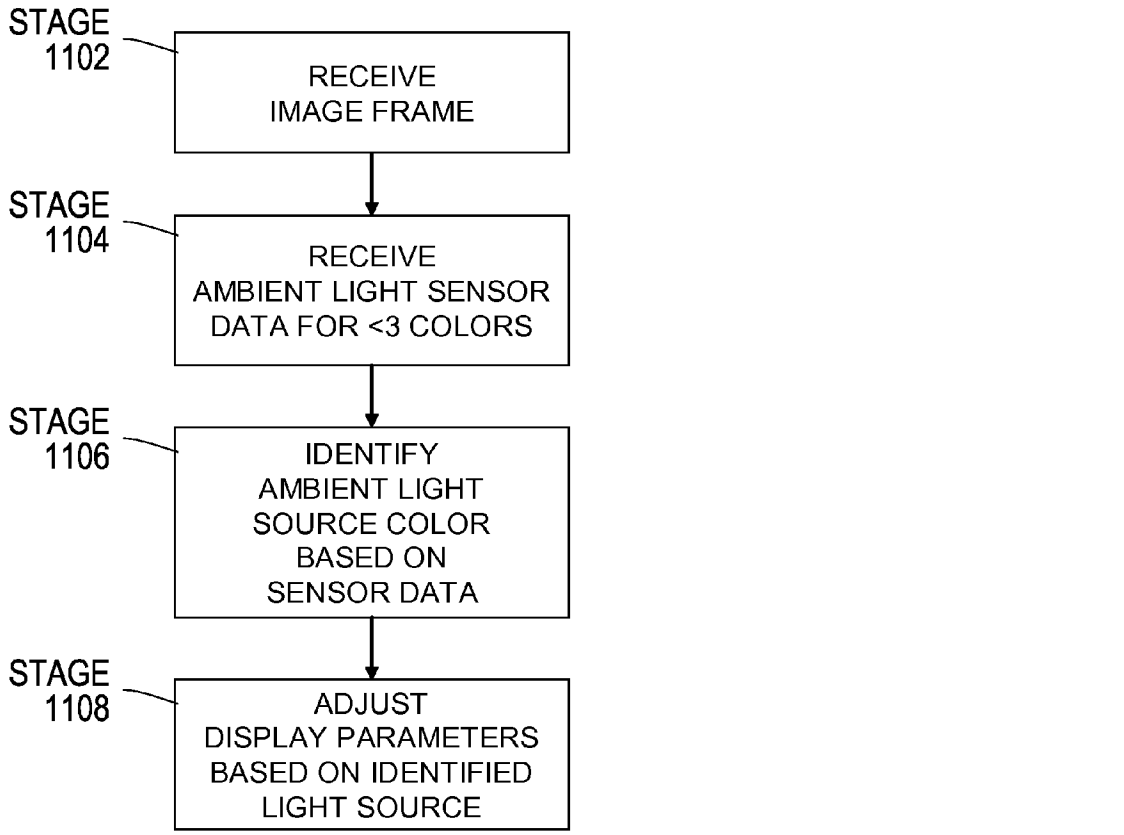
FIG. 11 shows a flow diagram of another example process for controlling a display backlight in response to ambient light data.

FIG. 11 shows a flow diagram of another example process 1100 for controlling a display backlight in response to ambient light data. The process 1100 modifies the display of images based on the detected illuminance of two different specific colors, instead of based on an overall illuminance value. More particularly, the process includes receiving an image frame (stage 1102), receiving ambient light sensor data for less than three colors (stage 1104), identifying an ambient light source based on the sensor data (stage 1106), and adjusting the display of the image frame based on the identified ambient light source (stage 1108).

The process 1100 begins with a controller obtaining image data (stage 1102) much as in stage 802 of the process 800. The controller then obtains ambient light sensor data for only two colors of light (stage 1104). The chromaticities of most ambient light sources fall at different points of a CIE color space diagram on or near the "black body" curve. The black body curve generally lies along an axis across the CIE color space stretching from blue to orange. As such, different ambient light sources can be identified by determining the degree to which the ambient light is composed of red or orange. Such a determination can be made from data associated with only two colors of ambient light.

Accordingly, in some implementations, the display controller 700 obtains ambient light data from a red or orange ambient light sensor and a blue ambient light sensor. In some other implementations, the controller obtains ambient light data from a white ambient light sensor and either a red or orange ambient light sensor. For the purposes of this application, an ambient light sensor that detects white light without discriminating between its constituent color components is considered to only be detecting one color of light.

Data from such pairs of ambient light sensors can be correlated to various ambient light sources with sufficient accuracy to allow the display controller 700 to identify the type of light source responsible for a given ambient light environment. That is, for example, based on a combination of red and white ambient light data, orange and white ambient light data, blue and orange, or based on a combination of blue and red ambient light data, the display controller 700 can distinguish between various sunlit conditions, such as direct sunlight or diffuse sunlight, fluorescent lighting, and incandescent lighting. In another example, the display controller 700 can infer the type of ambient light source from determining where, approximately, along an orange-blue axis the ambient light lies. To do so, during calibration of the display, the device can be exposed to various real and/or simulated ambient light conditions and the associated sensor readings can be stored in memory of the controller for later comparison in the form of a LUT, such as the color gamut correction LUT 714.

In operation, using the sensor data and the color gamut correction LUT 714, the display controller 700 identifies a current ambient lighting source (stage 1106). One significant difference between different light sources, is their white points, which are often different than a desired gamut white point. Thus, to accommodate for these differences, the color gamut correction LUT 714 stores correction values to apply to the display apparatus' LED illumination intensities to adjust the intensities of the primaries used by the display. In comparison to the process 800 described above, the primary color adjustments carried out with respect to the process 1100 are directed to adjusting the intensity of individual primary colors, as opposed to adjusting their chromaticities, or adjusting the size of a perceived color gamut as a whole, both of which may remain the same.

In some implementations, the two processes 800 and 1100 can be used together to implement both overall gamut size corrections based on overall ambient light levels, along with white point tuning based on an ambient light source identification. In some implementations, as described above, the ambient lighting data can be used to adjust other display parameters, including the number of subframes used to display an image or the overall brightness of the backlight. In such implementations, the number of subframes is inversely proportional to the ambient lighting levels, whereas brightness is directly proportional to ambient light levels.

Figure 12:
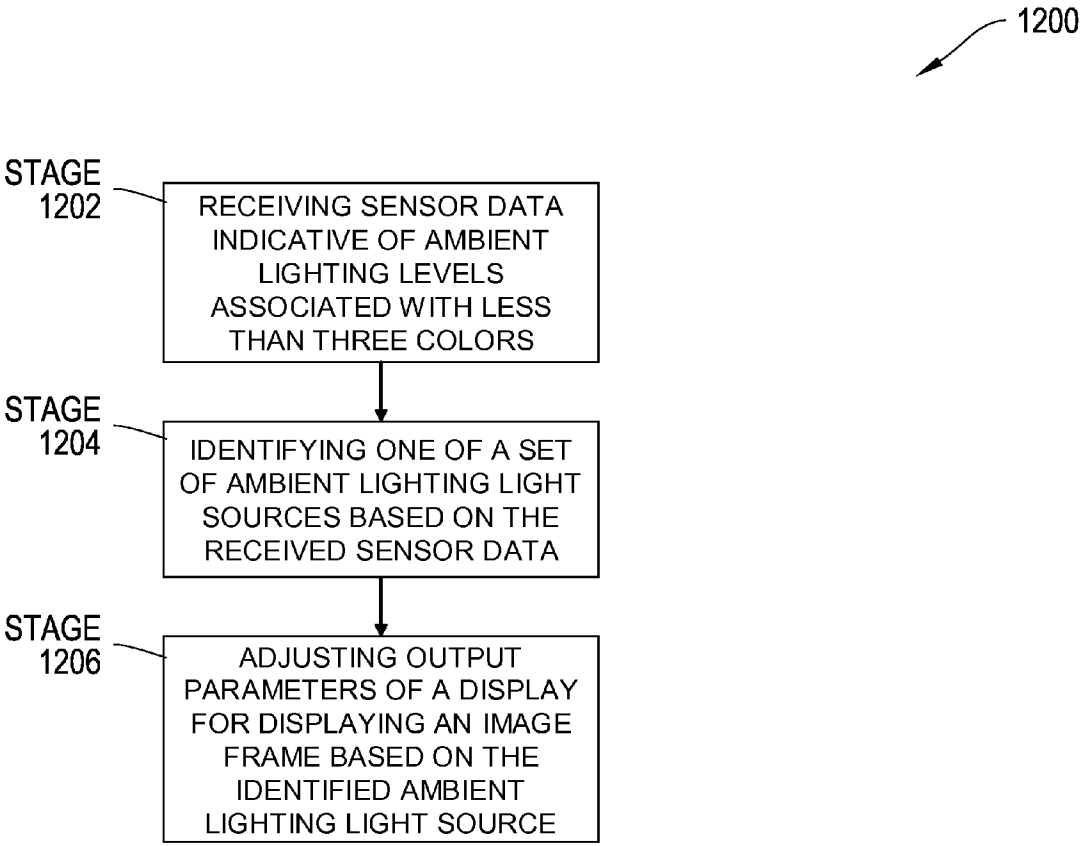
FIG. 12 shows a flow diagram of another example process 1200 for controlling a display backlight in response to ambient light data.

FIG. 12 shows a flow diagram of another example process 1200 for controlling a display backlight in response to ambient light data. The process 1200 is can be thought of as another representation of the process 1100 shown in FIG. 11. The process 1200 includes receiving sensor data indicative of ambient lighting levels associated with less than three colors (stage 1202). For example, the sensor data may indicate levels of either blue or white ambient light along with either red or orange ambient light. The received sensor data is then used to identify an ambient lighting light source (stage 1204). The light source identification stage can be carried out as described above in relation to stage 1106 of the process 1100. After the ambient light source is identified (stage 1204), output parameters of a display are adjusted to display an image frame based on the identified ambient lighting light source (stage 1206). The output parameter adjustment stage can include any of the adjustments described above in relation to stage 1108 of the process 1100.

Figure 13:
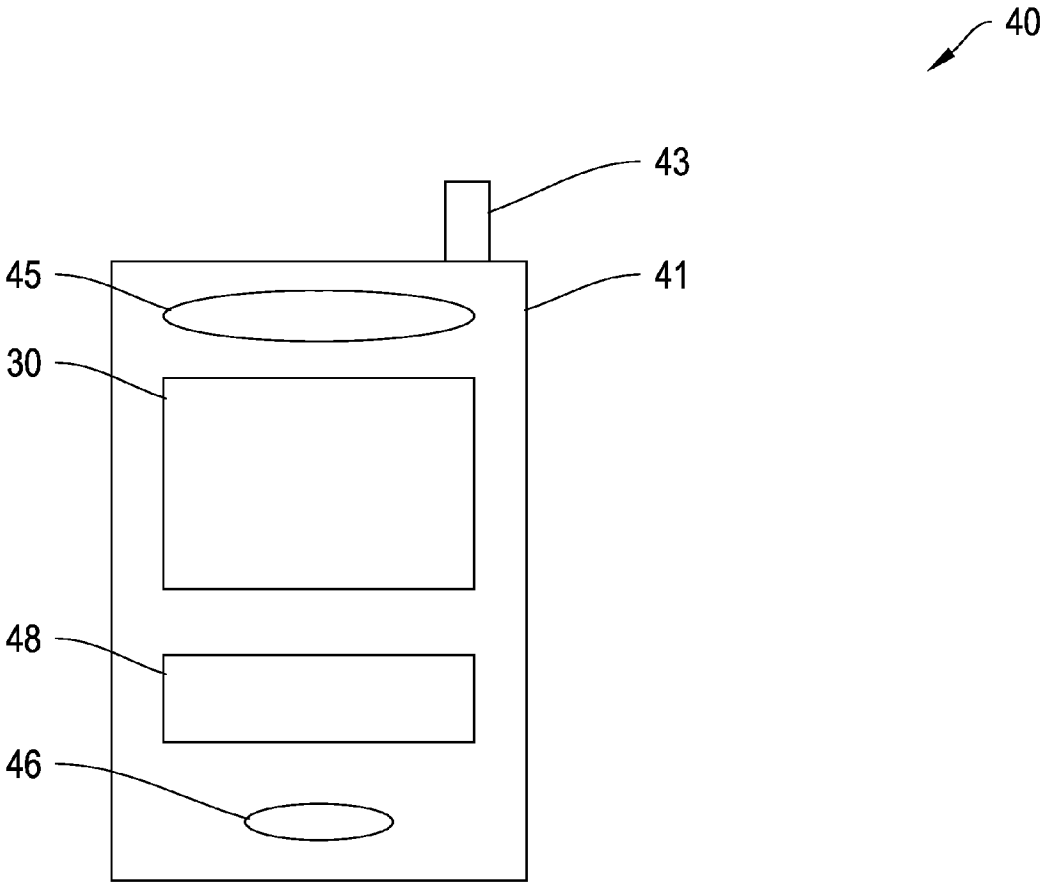
FIGS. 13 and 14 show system block diagrams of an example display device that includes a plurality of display elements.
Figure 14:
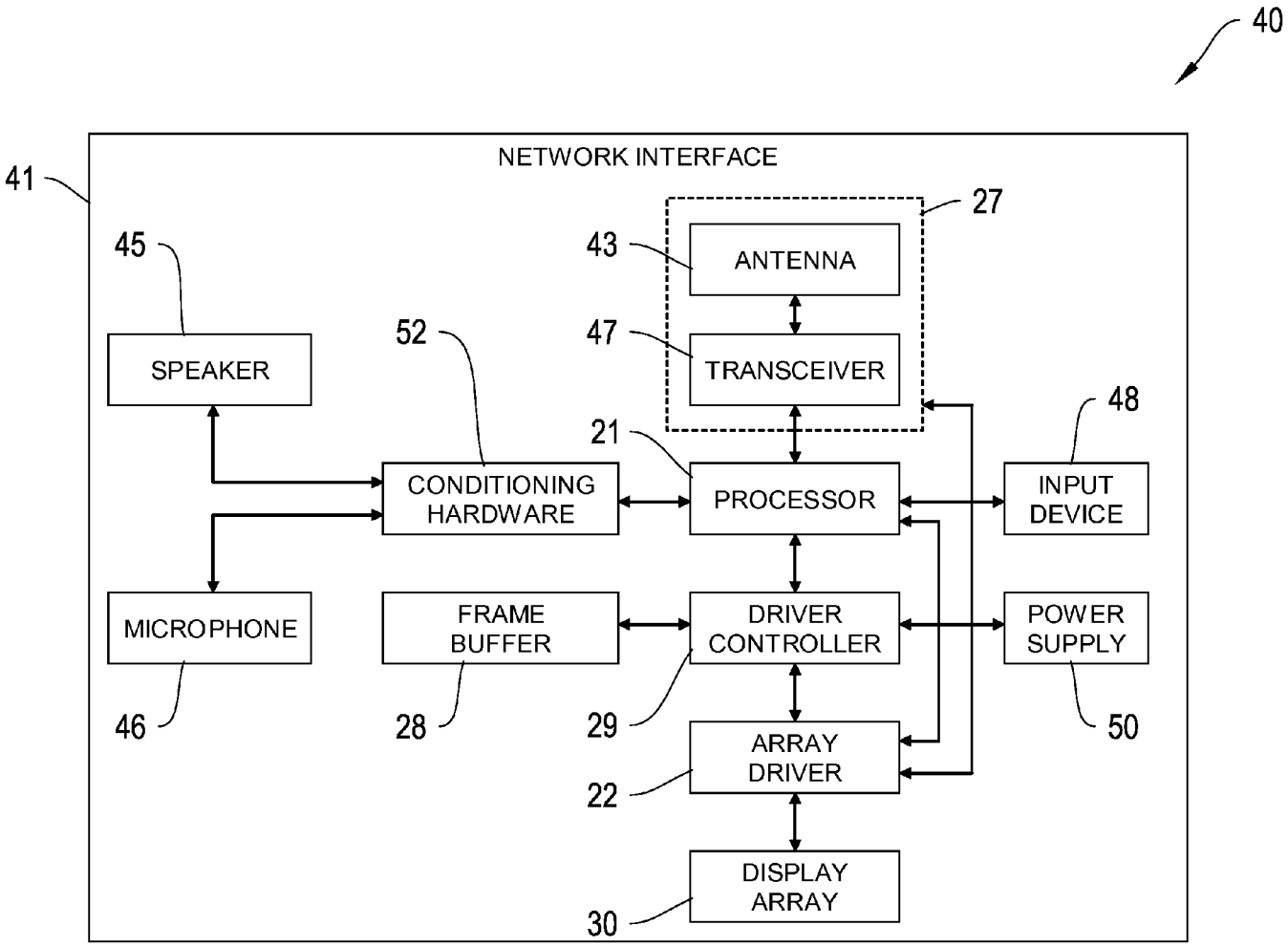

FIGS. 13 and 14 show system block diagrams of an example display device 40 that includes a plurality of display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, electroluminescent (EL) displays, OLED, super twisted nematic (STN) display, LCD, or thin-film transistor (TFT) LCD, or a non-flat-panel display, such as a cathode ray tube (CRT) or other tube device. In addition, the display 30 can include a mechanical light modulator-based display, as described herein.

The components of the display device 40 are schematically illustrated in FIG. 13. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 13, can be configured to function as a memory device and be configured to communicate with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1xEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G technology. The transceiver 47 can preprocess the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a standalone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements. In some implementations, the array driver 22 and the display array 30 are a part of a display module. In some implementations, the driver controller 29, the array driver 22, and the display array 30 are a part of the display module.

In some implementations, the driver controller 29, the array driver 22, and the display array 30 are appropriate for any of the types of displays described herein. For example, the driver controller 29 can be a conventional display controller or a bi-stable display controller (such as a mechanical light modulator display element controller). Additionally, the array driver 22 can be a conventional driver or a bi-stable display driver (such as a mechanical light modulator display element controller). Moreover, the display array 30 can be a conventional display array or a bi-stable display array (such as a display including an array of mechanical light modulator display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The processes of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An apparatus comprising:

a sensor input for receiving sensor data indicative of an ambient lighting condition;

output logic configured to simultaneously cause display light sources of at least two colors to be illuminated to form each of at least three generated primary colors, wherein each of the at least three generated primary colors corresponds to a nominal primary color of a nominal color gamut and has a chromaticity that is less saturated than a chromaticity of a corresponding light source; and color gamut correction logic configured, in response to detecting the ambient lighting condition indicated in the received sensor data, to cause the output logic to adjust the output of at least one display light source for each of the at least three generated primary colors to change the saturation of each of the at least three generated primary colors.

2. The apparatus of claim 1, wherein the output logic is configured, for a first of the generated primary colors, to cause a first display light source having a chromaticity similar to that of a first nominal primary color and a second display light source having a substantially different chromaticity from the first nominal primary color to be simultaneously illuminated.

3. The apparatus of claim 2, wherein the color gamut correction logic causes the output logic to adjust the output of the at least one display light source in response to the detected ambient lighting condition by causing the output logic to alter relative intensities at which the output logic causes the first and second display light sources to be simultaneously illuminated when forming the first generated primary color.

4. The apparatus of claim 2, wherein the color gamut correction logic causes the output logic to adjust the output of the at least one display light source in response to the detected ambient lighting condition by causing the output logic to reduce the relative intensity at which the output logic causes the second display light source to be illuminated when forming the first generated primary color in relation to the intensity at which the output logic causes the first display light source to be illuminated when forming the first generated primary color.

5. The apparatus of claim 2, wherein in forming a remainder of the generated primary colors, the color gamut correction logic causes the output logic to adjust the output of the display light sources in response to the detected ambient lighting condition such that a perceived white point of the generated color gamut of the display after the adjustment is the same as a perceived white point of the generated color gamut of the display before the adjustment.

6. The apparatus of claim 2, wherein the color gamut correction logic is configured to cause the output logic to adjust the output of the at least one display light source, when forming the first generated primary color, in response to the detected ambient lighting condition such that under the ambient lighting condition, the color gamut made available by use of the generated primary colors more closely replicates the nominal color gamut.

7. The apparatus of claim 2, wherein the color gamut correction logic is configured to cause the output logic to adjust the output of at least one display light source for each of the at least three generated primary colors such that the color gamut made available through use of the generated primary colors is a scaled version of the nominal color gamut.

8. The apparatus of claim 2, further comprising a memory storing a lookup table (LUT) storing a plurality of display light source output levels associated with a corresponding plurality of ambient light conditions, and wherein the color gamut correction logic causes the output logic to adjust the output of the at least one display light source, when forming the first generated primary color, in response to the detected ambient lighting condition by forwarding display light source output levels obtained from the LUT based on the ambient light conditions to the output logic.

9. The apparatus of claim 1, wherein the generated primary colors include red, green, and blue.

10. The apparatus of claim 1, wherein the nominal color gamut includes one of the sRGB and the Adobe RGB color gamut.

11. The apparatus of claim 1, wherein the at least one display light source includes a light emitting diode.

12. An apparatus comprising:

means for receiving sensor data indicative of an ambient lighting condition;

output control means configured to simultaneously cause display light sources of at least two colors to be illuminated to form each of at least three generated primary colors, wherein each of the at least three generated primary colors corresponds to a nominal primary color of a nominal color gamut and has a chromaticity that is less saturated than a chromaticity of a corresponding light source; and color gamut correction means configured, in response to detecting the ambient lighting condition indicated in the received sensor data, to cause the output control means to adjust the output of at least one display light source for each of the at least three generated primary colors to change the saturation of each of the at least three generated primary colors.

13. The apparatus of claim 12, wherein the output control means is configured, for a first of the generated primary colors, to cause a first display light source having a chromaticity similar to that of the first nominal primary color and a second display light source having a substantially different chromaticity from the first nominal primary color to be simultaneously illuminated.

14. The apparatus of claim 13, wherein the color gamut correction means causes the output control means to adjust the output of the at least one display light source in response to the detected ambient lighting condition by causing the output control means to alter relative intensities at which the output control means causes the first and second display light sources to be simultaneously illuminated when forming the first generated primary color.

15. The apparatus of claim 13, wherein the color gamut correction means causes the output control means to adjust the output of the display light sources, when forming a remainder of the generated primary colors, in response to the detected ambient lighting condition such that a perceived white point of the generated color gamut of the display after the adjustment is the same as a perceived white point of the generated color gamut of the display before the adjustment.

16. The apparatus of claim 13, wherein the color gamut correction means is configured to cause the output control means to adjust the output of the at least one display light source, when forming the first generated primary color, in response to the detected ambient lighting condition such that under the ambient lighting condition, the color gamut made available by use of the generated primary colors more closely replicates the nominal color gamut.

17. The apparatus of claim 13, wherein the color gamut correction means is configured to cause the output control means to adjust the output of at least one display light source for each of the at least three generated primary colors such that the color gamut made available through use of the generated primary colors is a scaled version of the nominal color gamut.

18. The apparatus of claim 13, further comprising a storage means storing lookup table (LUT) that includes a plurality of display light source output levels associated with a corresponding plurality of ambient light conditions, and wherein the color gamut correction means causes the output control means to adjust the output of the at least one display light source, when forming the first generated primary color, in response to the detected ambient lighting condition by forwarding light source output levels obtained from the LUT based on the ambient light conditions to the output control means.

19. A method for adjusting the operation of a display based on ambient lighting conditions, comprising:

receiving sensor data indicative of an ambient lighting condition;

simultaneously causing light sources of at least two colors to be illuminated to form each of at least three generated primary colors, wherein each of the at least three generated primary colors corresponds to a nominal primary color of a nominal color gamut and has a chromaticity that is less saturated than a chromaticity of a corresponding display light source; and in response to detecting the ambient lighting condition indicated in the received sensor data, adjusting the output of at least one display light source for each of the at least three generated primary colors to change the saturation of each of the at least three generated primary colors.

20. The method of claim 19, wherein adjusting the output of the at least one display light source in response to the detected ambient lighting condition includes altering relative intensities at which at least two display light sources associated with different colors are simultaneously illuminated when forming a first generated primary color.

21. The method of claim 19, further comprising storing in a lookup table (LUT) a plurality of display light source output levels associated with a corresponding plurality of ambient light conditions, and adjusting the output of the at least one display light source, when forming a first generated primary color, in response to the detected ambient lighting condition includes adjusting the output of the at least one display light source based on display light source output levels obtained from the LUT.

* * * * *